US011615649B2

(12) United States Patent
Pinkus et al.

(10) Patent No.: US 11,615,649 B2
(45) **Date of Patent: *Mar. 28, 2023**

(54) SYSTEMS AND METHODS FOR PAIRING OF FOR-HIRE VEHICLE METERS AND MEDALLIONS

(71) Applicant: IVSC IP LLC, Las Vegas, NV (US)

(72) Inventors: Michael Collins Pinkus, Alpharetta, GA (US); Mark A. James, Las Vegas, NV (US)

(73) Assignee: IVSC IP LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/549,216

(22) Filed: Dec. 13, 2021

(65) Prior Publication Data

US 2022/0101656 A1 Mar. 31, 2022

Related U.S. Application Data

(63) Continuation of application No. 16/178,480, filed on Nov. 1, 2018, now Pat. No. 11,200,755, which is a (Continued)

(51) Int. Cl.
*G07B 13/04* (2006.01)
*G07B 13/00* (2006.01)

(Continued)

(52) U.S. Cl.
CPC ..... *G07B 13/00* (2013.01); *G07C 5/008* (2013.01); *G07C 5/08* (2013.01); *G06Q 2240/00* (2013.01); *G07B 13/04* (2013.01)

(58) Field of Classification Search
CPC .... G07F 13/00; G06Q 30/0284; G06Q 50/30; G06Q 2240/00
See application file for complete search history.

(56) References Cited

U.S. PATENT DOCUMENTS 4,882,570 A * 11/1989 Martinez ..... G07B 13/045 340/472
5,155,747 A * 10/1992 Huang ..... G01G 23/37 377/16

(Continued)

OTHER PUBLICATIONS

Harris, Taxicab Economics: The Freedom to Contract for a Ride, 1 GEO. J.L. & PUB. POL'Y 195, 2003, pp. 195-222 (Year: 2003).*

(Continued)

*Primary Examiner* — Daniel Vetter
(74) *Attorney, Agent, or Firm* — Peacock Law P. C.; Justin R. Jackson

(57) ABSTRACT

Systems and methods for pairing for-hire vehicles with their associated medallion are disclosed. Some for-hire vehicles, such as taxis operate with a for-hire vehicle meter (taximeter). In some embodiments, the meter contains an identifier of a medallion that is associated with the meter. The meter may then determine if it is connected or properly associated with the medallion. If the meter is connected or properly associated with the medallion, it will then access the identification information of the medallion and determine if identification information matches its contained medallion identifier. If the identification information does not match, the meter may shut down and thereafter be non-engageable. The relationship between the medallion and the meter is advantageously used to enforce restrictions on the operation of the for-hire vehicle including, for example, time and location of pick-up restrictions. In other embodiments, meters and medallions communicate their identification and locations to a central server. The central server then compares the locations to determine the distance between the meter and the medallion. If the distance does not satisfy a predetermined range (indicating the meter and the medallion are close together), the central server may generate an alert or it may command the meter to shut down. The central (Continued)

server may also advantageously be used to enforce restrictions on the operation of the for-hire vehicle. Meters and/or medallions not attached to their assigned medallion and/or meter may also be tracked via the central server.

20 Claims, 15 Drawing Sheets

Related U.S. Application Data continuation of application No. 14/719,250, filed on May 21, 2015, now abandoned, which is a continuation of application No. 13/225,352, filed on Sep. 2, 2011, now abandoned.

(51) Int. Cl.
*G07C 5/08* (2006.01)
*G07C 5/00* (2006.01)

(56) References Cited

U.S. PATENT DOCUMENTS

| | | | | |
|---|---|---|---|---|
| 8,630,897 | B1 | 1/2014 | Prada Gomez et al. | |
| 2002/0107027 | A1 | 8/2002 | ONeil | |
| 2002/0111154 | A1 | 8/2002 | Eldering et al. | |
| 2002/0156699 | A1 | 10/2002 | Gray et al. | |
| 2002/0170962 | A1 | 11/2002 | Besling et al. | |
| 2004/0119589 | A1 | 6/2004 | French et al. | |
| 2004/0176081 | A1 | 9/2004 | Bryham et al. | |
| 2006/0095329 | A1 | 5/2006 | Kim | |
| 2006/0131401 | A1 | 6/2006 | Do et al. | |
| 2006/0135120 | A1 | 6/2006 | Likourezos | |
| 2007/0125843 | A1 | 6/2007 | Byerly et al. | |
| 2007/0213047 | A1 | 9/2007 | Kolker | |
| 2008/0018730 | A1 | 1/2008 | Roth | |
| 2010/0299207 | A1 | 11/2010 | Harlev et al. | |
| 2011/0022474 | A1 | 1/2011 | Jain et al. | |
| 2011/0022477 | A1 | 1/2011 | Hatridge et al. | |
| 2011/0047062 | A1 | 2/2011 | Kerschner et al. | |
| 2011/0055309 | A1 | 3/2011 | Gibor et al. | |
| 2011/0213618 | A1 | 9/2011 | Hodge et al. | |
| 2012/0303533 | A1* | 11/2012 | Pinkus | G06Q 30/02 713/160 |
| 2013/0054361 | A1 | 2/2013 | Rakshit | |

OTHER PUBLICATIONS

Rawley, Information, Knowledge, and Asset Ownership in Taxicab Fleets, Columbia Business School Summer Conf., Jun. 2009 (Year: 2009).*

* cited by examiner

FIG. 9

CURRENT ASSIGNMENTS

| OWNER | METER SERVER NUMBER | MEDALLION NIMBER | VIN |
|---|---|---|---|
| KING CAB | KZP1123456 | 1B44 | 1FMHP72W0A11111 |
| KING CAB | KZP1123457 | 4A99 | 1FMHP72W0A22222 |
| RED TAXI | KZP1123458 | 9C93 | 1FMHP72W0A33333 |
| RED TAXI | KZP1123555 | 8X42 | 1FMHP72W0A44444 |
| SMITH, JOHN | KZP009998 | 3Y54 | 1FMHP72W0A55555 |
| SUPER LIMO | QAB448880 | 9K64 | 1FMHP72W0A66666 |

910

CREATE NEW ASSIGNMENT

OWNER KING CAB 951

METER KZP1123456 952

MEDALLION 1B44 953

VIN: 954

CREATE

950

SYSTEMS AND METHODS FOR PAIRING OF FOR-HIRE VEHICLE METERS AND MEDALLIONS

INCORPORATION BY REFERENCE TO ANY PRIORITY APPLICATIONS

This application is a continuation of U.S. patent application Ser. No. 16/178,480, filed on Nov. 1, 2018, entitled "Systems and Methods for Pairing of For-Hire Vehicle Meters and Medallions", which itself was a continuation of U.S. patent application Ser. No. 14/719,250, filed on May 21, 2015, entitled "Systems and Methods for Pairing of For-Hire Vehicle Meters and Medallions", which itself was a continuation of U.S. patent application Ser. No. 13/225,352, filed on Sep. 5, 2011, entitled "Systems and Methods for Pairing of For-Hire Vehicle Meters and Medallions", the specifications and claims of which are incorporated herein by reference.

REFERENCE TO CO-PENDING APPLICATIONS OF APPLICANT

The present disclosure contains subject matter that is related to applicant's co-pending applications:

SYSTEM AND METHOD FOR SECURING, DISTRIBUTING AND ENFORCING FOR-HIRE VEHICLE OPERATING PARAMETERS, Ser. No. 13/116,856 (now abandoned) and SYSTEM AND METHOD FOR INDEPENDENT CONTROL OF FOR-HIRE VEHICLES, Ser. No. 13/225,360, (now issued as U.S. Pat. No. 9,037,852)

which are both incorporated by reference in their entirety herein.

BACKGROUND

The present disclosure relates to the field of for-hire vehicles such as taxis, limousines, shuttles, buses or any other vehicle that provides shared transportation or transports one or more paying passengers between locations of the passengers' choice.

A for-hire vehicle (FHV) generally charges fares for transporting a passenger from one location to another. Some FHVs, such as taxicabs, operate with a meter. The primary purpose of a meter is to calculate fares for the passengers that hire the FHV. For example, the meter may charge an initial fee to start a trip and then may calculate a fee per every one-eighth mile traveled. The fares are generally displayed in a manner so that the passenger may view the calculation of the fare during the trip. A meter serves as a way to fairly and accurately calculate the total amount the passenger will be charged for the trip in the FHV. Meter-operated FHVs may differ from non-meter operated FHVs because in the former, the passenger's fare is calculated as the trip progresses while in the latter, the fare may be negotiated before the passenger is picked up.

The operation and maintenance of FHVs and meters is highly regulated. The entity charged with developing and enforcing the regulations ("regulatory agency") for a jurisdiction generally imposes several requirements on operators of FHVs. For example, the regulatory agency may require the operator to obtain a certificate of public convenience and necessity, which certifies that the operator is fit to operate a FHV or fleet of FHVs and that the vehicle or vehicles used to transport members of the public comply with certain minimum standards. Regulatory agencies may also issue permits or licenses to drivers of FHVs authorizing them to drive a FHV within the regulatory agency's jurisdiction for a period of time such as a year. In addition to certificates of public convenience and necessity and permits (or FHV drivers' licenses), regulatory agencies may also issue medallions to meter-operated FHVs. Medallions are generally unique within a single jurisdiction and may be identified by a serial number, or medallion number and are associated with only a single FHV at any one time. In addition, the existence of the medallion is ascertainable when in the presence of the FHV to which the medallion is currently assigned. For example, medallions are currently affixed to meter-operated FHVs by the regulatory agency authorizing it to be operated within the agency's jurisdiction. For example, in some jurisdictions, such as Nevada, a medallion is a metal plate affixed to the exterior of the FHV. Some medallions authorize unrestricted use of a FHV within the jurisdiction, while other medallions only authorize use during certain times or in certain geographic regions. For example, one medallion may permit twenty-four hour a day, seven day a week, operation, while another may only permit operation during certain hours on the weekends. Medallions may be colored coded to indicate the nature of the authorization. A twenty-four hour medallion may be a red metal plate with black lettering while a weekend only medallion may be a black metal plate with white lettering, for example. In order for the FHV to be operating within regulations, its associated medallion must generally be displayed so that enforcement officers and/or passengers may view the medallion. A regulatory agency may also impose and enforce geographic or time restrictions on the certificate of public convenience and necessity ("CPCN") of a FHV operator. A CPCN is the statutory or regulatory form of a FHV owner or operator's license in many jurisdictions. As used herein, CPCN (or "certificate") is meant to refer to the FHV owner's or operator's general certificate of license to operate as granted by the regulatory agency, jurisdiction, or governmental body, however denominated. In this instance, all of the medallions of such an operator will carry such basic certificate restrictions, in addition to any restrictions placed on the specific medallions allocated to such operator, if any. For example, the regulatory agency may issue a certain number of medallions to all certificate holders in the jurisdiction that may be operated from noon to 2 AM, seven days per week. A FHV operator in the jurisdiction with a certificate restricting passenger pick-ups to a geographic area "west of the interstate," for example, could operate the new medallion from noon to 2 AM, 7 days a week, but only for pick-ups "west of the interstate" even though the newly issued medallions do not have geographic restrictions. On the other hand, competitors with unrestricted certificates could operate the same newly issued medallions during the permitted times and pick-up passengers anywhere within the jurisdiction.

In many areas, medallions are used as a means to limit the number of meter-operated FHVs within the jurisdiction. In some areas, such as New York, the number of available medallions is fixed by statute and does not increase absent amending the statute. As a result, the number of available medallions may stay fixed for long periods of time. In urban or tourist areas, such as New York, where there is a high demand for meter-operated FHVs, medallions may be very valuable because the demand to operate FHVs is relatively high while the supply of medallions may be relatively low. Due to the high value of medallions, they can be the subject of fraud or theft. Fraud may occur where a medallion had been reported lost, stolen or destroyed and is replaced by the regulatory agency; but in fact, the claim that the medallion was lost, stolen or destroyed may be fraudulent and both the original medallion and the new medallion are in use. Fraud may also occur when a counterfeit medallion is produced and affixed to a vehicle attempting to operate as regulatory agency approved meter-operated FHV. Medallions may also be easy to steal since they are generally affixed to the exterior of the FHV. Thus, in some jurisdictions, all meter-operated FHVs authorized to pick up passengers from the street in response to a hail or at designated public passenger pick up locations are required to have a medallion and a meter.

BRIEF DESCRIPTION OF THE DRAWINGS

FIG. 9 and FIG. 10 show exemplary embodiments of user interfaces that may be available on central server

DETAILED DESCRIPTION OF EMBODIMENTS

Embodiments of the disclosure will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the disclosure. Furthermore, embodiments of the disclosure may include several novel features, no single one of which is solely responsible for its desirable attributes or which is essential to practicing the embodiments of the disclosure herein described.

Currently, there is no connection or verification between the medallion and the meter. If a medallion is removed from a for-hire vehicle ("FHV"), or if the FHV has a counterfeit or fraudulent medallion, the meter may still operate. In addition, a FHV's meter may still operate even though its medallion was fraudulently reported as lost, stolen or destroyed. Currently, the meter of a FHV will also continue to operate even though the FHV may be operating outside the authority granted by its medallion or its operator's certificate. For example, if a meter-operated FHV has a medallion only authorizing it to accept passengers in the north side of the county, but the FHV is picking up passengers in the south side of the county, the meter will continue to calculate fares and will display no warning to passengers that FHV is operating without authorization.

Accordingly, the embodiments described in the present disclosure provide systems and methods for pairing medallions to FHV meters to ensure that a FHV must have both in order to be in compliance with regulations. Additional embodiments described in the present disclosure provide system and methods for validating that an FHV meter is accepting fares according to the authorization provided for by its paired medallion. This approach permits automatic and immediate enforcement of all certificate and medallion restrictions. Thus, before a meter is permitted to be engaged for a new fare for a paying passenger ("first engaged"), the certificate and medallion restrictions are advantageously confirmed.

Figure 1:
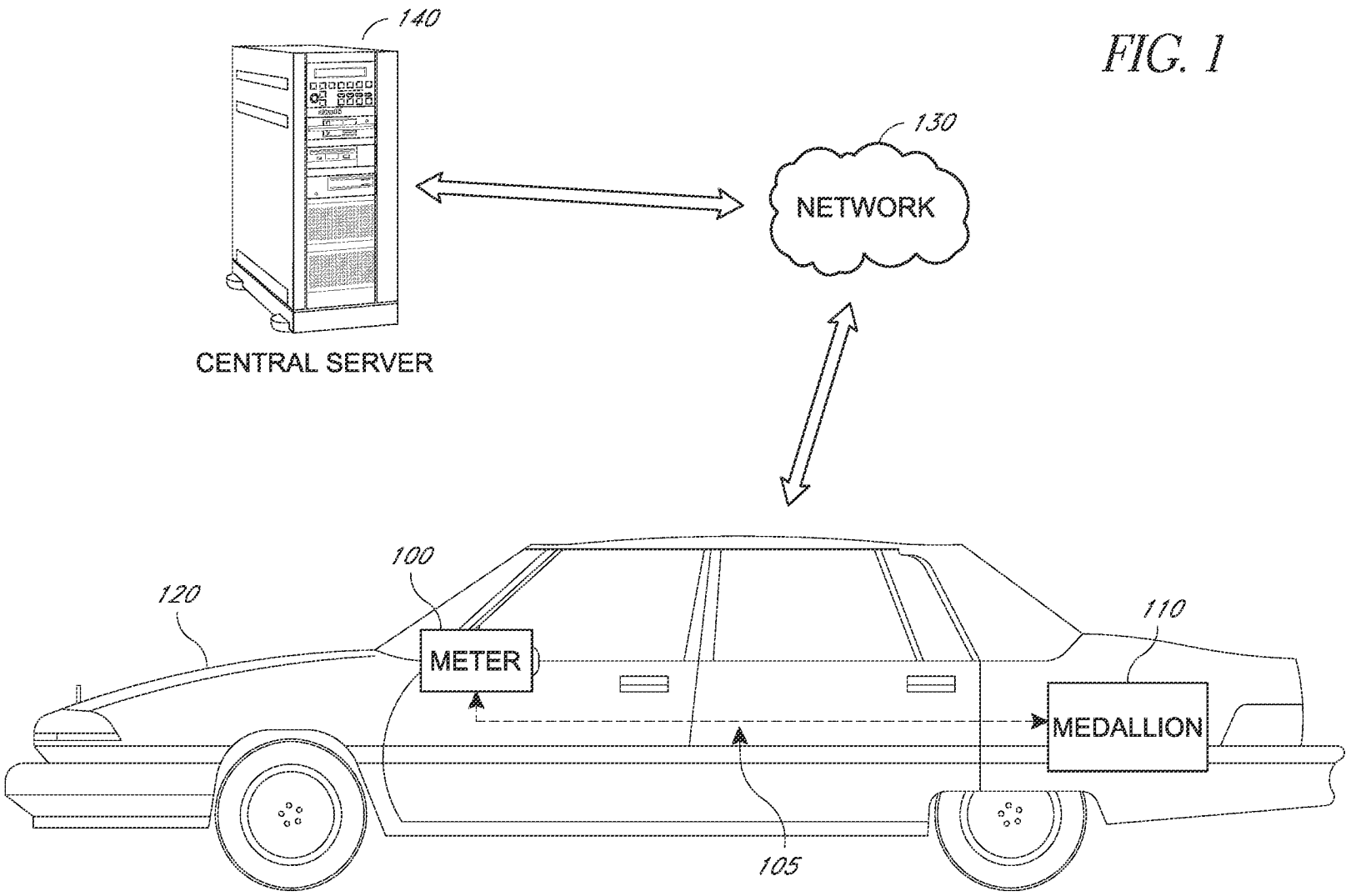
FIG. 1 is a block diagram showing one embodiment of a for-hire vehicle ("FHV") comprising a FHV meter and a medallion in communication with a central server over a network.

FIG. 1 is block diagram showing one embodiment of for-hire vehicle ("FHV") 120 comprising for-hire vehicle meter 100 ("FHV Meter 100") and medallion 110 in communication with central server 140 over network 130. FHV Meter 100 may calculate fares and otherwise operate based on a number of operating parameters programmed within it. Medallion 110 is a physical representation of an authorization to operate FHV 120 within a particular region. Medallion 110, in some embodiments, may be attached to the exterior of FHV 120. For example, in FIG. 1, medallion 110 is attached to the rear driver side of FHV 120. In other embodiments, medallion 110 may be attached to the hood of FHV 120, or any other part of the exterior of the vehicle. In other embodiments, medallion 110 may be attached to the window or windshield of FHV 120.

In one embodiment, medallion 110 may comprise an indication of an identifier uniquely identifying the medallion. For example, the medallion 110 may contain a string of characters corresponding to the medallion number assigned to the FHV 120. The string may be, for example, "9C93" or "AB8Z". In other embodiments, medallion 110 may be color coded so that enforcement officers may quickly determine if the FHV 120 to which medallion 110 is attached is legally collecting fairs within the terms of its medallion. For example, in some jurisdictions, accepting fares or picking up passengers at the airport may be restricted and only those for-hire vehicles with medallions to operate at the airport may collect fares. In such embodiments, medallion 110 may be orange, or any other designated color, indicating that pick up at the airport is permitted under the terms of the medallion attached to the FHV 120.

In some embodiments, FHV Meter 100 and medallion 110 are connected via connection 105, thereby establishing a connected medallion-meter pair. Connection 105 may be a wired connection, or other embodiments may be a wireless connection. In some embodiments, connection facilitates communication between medallion 110 and FHV Meter 100. FHV Meter 100 may, for example, be able to determine the identification number of medallion 110 via connection 105.

In other embodiments, medallion 110 and FHV Meter 100 engage in two way communication through connection 105.

Connection 105 may be a wired connection, such as for example, a USB cable. In such embodiments, connection 105 may serve as a means to provide power to medallion 110 in addition to allowing data transfer between FHV Meter 100 and medallion 110. The wired connection may connect FHV Meter 100 and medallion 110 such that the first end of a cable is connected to FHV Meter 100 and the second end of the cable is connected to medallion 110. For example, FHV Meter 100 may have a USB Standard A Receptacle and medallion 110 may have a USB Standard B Receptacle thereby allowing FHV Meter 100 and medallion 110 to be connected via a standard USB cable with a USB Standard A plug on one end and a USB Standard B plug on the other end. In other embodiments, connection 105 may be an electrical wire soldered into the meter and the medallion. It may be appreciated by one skilled in the art that any wire or cable allowing for transfer of data and/or power In other embodiments, connection 105 may be a wireless connection. The wireless connection may be any known technology in the art, such as for example, radio-frequency (RF) communication, Bluetooth, IEEE 802.11, infrared communication, visible light communications, light spectrum communications, or any other means known in the art for transferring data between two devices that are not physically connected. In embodiments where connection 105 is wireless, both FHV Meter 100 and medallion 110 comprise appropriate hardware to facilitate communications. For example, if connection is made via RF, then both FHV Meter 100 and medallion 110 would comprise RF transmitters and receivers so that communication may occur. In some embodiments, the communication may be one way, that is, medallion may broadcast data via connection and FHV Meter 100 may receive the data. In such embodiments, FHV Meter 100 would not send data to medallion 110 over connection 105. One example of the communication between FHV Meter 100 and medallion 110 is discussed in more detail with respect to FIG. 5.

The embodiment of FIG. 1 also contains network 130 and central server 140 in communication with FHV 120. Central server 140 may be a computing system controlled by the regulatory agency that regulates FHVs in a particular jurisdiction. For example, New York City Taxi and Limousine Commission or the State of Nevada Taxicab Authority may operate central server 140. In another embodiment, a company that operates a fleet of for-hire vehicles ("FHVs") may operate central server 140. The company may exist in a jurisdiction that allows fleet owners the ability to manage and maintain medallions as opposed to a regulatory agency. Any communications that occur between FHV 120 and central server 140 may be accomplished via network 130. Network 130 may be, in some embodiments, a computer network. Depending on the embodiment, network 130 may comprise one or more of any type of network, such as one or more local area networks, wide area networks, personal area networks, telephone network, and/or the Internet, which may be accessed via any available wired and/or wireless communication protocols. Thus, network 130 may comprise a secure LAN through which FHV 120 and central server 140 may communicate, and network may further comprise an Internet connection through which FHV Meter 100 and central server 140 communicate. Any other combination of networks, including secured and unsecured network communication links, are contemplated for use in the systems described herein.

In some embodiments, it may be advantageous for FHV 120 and central server 140 to communicate regarding the status of connection 105. The regulatory agency managing central server 140 may wish to monitor the status of connections between FHV Meter 100 and medallion 110. For example, the regulatory agency may wish to know which meters are not connected to medallions in the field. More detail with respect to monitoring medallion-meter pairs operating in the regulatory agency's jurisdiction is discussed in more detail with respect to FIGS. 7-10.

In some embodiments, the connection status for all medallion-meter pairs is communicated to central server 140. In such embodiments, central server 140 may maintain a data structure containing a pairing of every FHV Meter 100 in the jurisdiction along with its associated medallion (a "medallion-meter pair") and current connection status of the medallion-meter pair. For example, if FHV Meter 100 with serial number 111 is assigned to medallion with medallion number 999, central server 140 may maintain a data structure linking serial number 111 associated with medallion number 999. In addition, the data structure may include a connection status that reflects whether FHV Meter 100 with serial number 111 is connected or disconnected from the medallion associated with medallion number 999. Central server 140 may, in some embodiments, display the connection status in user interface.

In other embodiments, the status connection may be event driven, that is, central server 140 is only notified when FHV Meter 100 is connected or disconnected to medallion 110. Upon a connect or disconnect, FHV Meter 100, or in some embodiments medallion 110, may transmit a message containing a notification of the connect or disconnect event to a reporting computer system such as central server 140. The reporting computer system may then handle the event in a variety of ways. In some embodiments, central server 140 may only receive messages containing disconnect events, that is, event messages sent when medallion 110 is disconnected from the FHV Meter 100. Upon receipt of a disconnect message, central server 140 may, in some embodiments, send a message to FHV Meter 100 attached to FHV 120 that sent the disconnect message instructing the FHV Meter 100 to shut down (a "kill message"). FHV Meter 100 may shut down, in some embodiments, by turning off immediately. In other embodiments, FHV Meter 100 may shut down by completing the current fare, but not accepting any additional fares until it returns to compliance (not become "first engaged"). In some embodiments, FHV Meter 100 may be connected to the computer system of FHV 120 and may shut down FHV 120 (e.g., command the engine of FHV 120 not to operate) until FHV Meter 100 returns to compliance. In such embodiments, the regulatory agency may have a way of overriding the FHV 120 shutdown function so that the vehicle may be moved if safety or other public interest concerns warrant it. The override may be a message sent to FHV Meter 100 by central server 140, or in other embodiments, the override may be a key, or USB dongle, that can be inserted directly into FHV Meter 100. In other embodiments, central server 140 may issue a warning, such as graphical display, email alert, electronic alert, or any other kind of alert notification known in the art upon receipt of a disconnect event. Alerts may be displayed on central server 140 as described with respect to FIGS. 7-10.

In some embodiments, the system of FHV 120 of FIG. 1 may be self-contained and may not communicate with central server 140. For example, FHV Meter 100 may communicate via connection 105 with medallion 110 and based on that communication, determine whether it should continue to operate. For example, FHV Meter 100 may be configured to operate with a specific medallion. The configuration may include, for example, the licensing or medallion number for which the FHV Meter 100 may need to operate. In self contained embodiments, FHV Meter 100 may poll medallion 110 for the medallion's ID to make sure that the connected medallion is the medallion FHV Meter 100 expects. If the medallion ID is unexpected, or if no medallion ID is returned, FHV Meter 100 may cease operation. The communication between FHV Meter 100 and medallion are discussed in more detail with respect to FIG. 5.

In some embodiments, the communications between FHV Meter 100 and medallion 110 may be encrypted. In such embodiments, FHV meter 100 and medallion 110 may have means for implementing an encryption protocol to facilitate communications. The communications may be implemented with an encryption algorithm such as for example, Data Encryption Standard (DES), Advanced Encryption Standard (ADS), Pretty Good Privacy (PGP), International Data Encryption Algorithm (IDEA), Blowfish, RCS, CAST, etc. One skilled in the art can appreciate that any encryption algorithm may be used to encrypt communications between FHV Meter 100 and medallion 110.

In some embodiments, FHV Meter 100 may not be configured to operate with a specific medallion. Rather, it may be configured to operate with any medallion. In such embodiments, FHV Meter 100 may not poll medallion 110 for its medallion number or otherwise communicate with medallion 110 other than to determine if the medallion is within an expected distance of FHV Meter 100. In some embodiments where connection 105 is a wired connection, medallion may operate to complete a circuit that FHV Meter 100 monitors. If medallion 110 is removed from connection 105 by detaching it, the circuit breaks and FHV Meter 100 is alerted that medallion 110 is no longer connected to it. In other embodiments where connection 105 is a wireless connection, FHV Meter 100 may detect the distance medallion 110 is from the FHV Meter 100 and if the distance exceeds an expected distance operating parameter stored in FHV Meter 100, FHV Meter 100 is alerted that medallion 110 is no longer connected to it. Advantageously, the expected distance may be in the range of 0-10 meters, but in some embodiments may smaller, such as 1-4 meters. It can be appreciated by those skilled in the art that the expected range must be sufficient to accommodate the distance between meters and medallions as set by the regulatory agency. For example, if medallion 110 is to be affixed to the rear driver side of FHV 120, thus separating FHV Meter 100 from medallion 110 by 2.5 meters, the expected distance operating parameter stored in FHV Meter 100 must be at least as large as 2.5 meters, but should not be so much larger that a medallion may be separated from its associated meter.

In some embodiments, FHV Meter 100 may be dynamically associated with medallion 110. For example, FHV Meter 100 may be associated with medallion 110 via a secured data packet transmitted to FHV Meter 100 as disclosed in applicant's previous co-pending application SYSTEM AND METHOD FOR SECURING, DISTRIBUTING AND ENFORCING FOR-HIRE VEHICLE OPERATING PARAMETERS, Ser. No. 13/116,856, which is incorporated herein by reference. In some embodiments, such as those disclosed in application Ser. No. 13/116,856, FHV Meter 100 may be operating according to operating parameters sent to FHV Meter 100 in a secure data packet created by the regulatory agency computer system such as central server 140. The operating parameters instruct FHV meter 100 how to operate. In such embodiments, one of the operating parameters may be an identifier associated with medallion 110. This may be advantageous, for example, in embodiments where FHV meter 100 may operate with more than one medallion. When a new medallion is associated with FHV meter 100, central server 140 may send a new encrypted data packet to FHV meter 100. Once received, FHV meter 100 may decrypt the packet and use the new associated medallion identifier in accordance with the embodiments disclosed herein. The medallion identifier may be formatted in similar manner to other parameters as described in application Ser. No. 13/116,856. For example, the medallion identifier may be formatted as a string, such as "9YRX", as a data object, XML object, byte stream, or any other format for transferring data between computer systems known in the art.

In one embodiment, FHV meter 100 may only start a fare, or become first engaged, if it is operating according to the restrictions of medallion 110 and receives validation from the medallion. Advantageously, medallion 110 is programmed with authorization rules. In other embodiments, FHV meter 100 is programmed with the authorization rules. The authorization rules correspond to the authorization the medallion, or the FHV operator's certificate, grants to FHV 120. For example, some medallions or certificates authorize operation of FHVs during nights or weekends only. In such cases, medallion 110 may be programmed with an authorization rule that only allows fares to be collected at nighttime or during weekend hours. Medallions or certificates may also be restricted to a geographic location, that is, the medallion or certificate may only authorize passenger pick up in certain defined areas within the regulatory agency's jurisdiction of control. For example, a medallion or certificate may only allow for passengers to be picked up on the west side of the jurisdiction. In such embodiments, medallion 110 may be programmed with GPS coordinates defining its boundary of operation. The validation communication between FHV Meter 100 and medallion 110 are discussed in more detail with respect to FIG. 5A.

Figure 2:
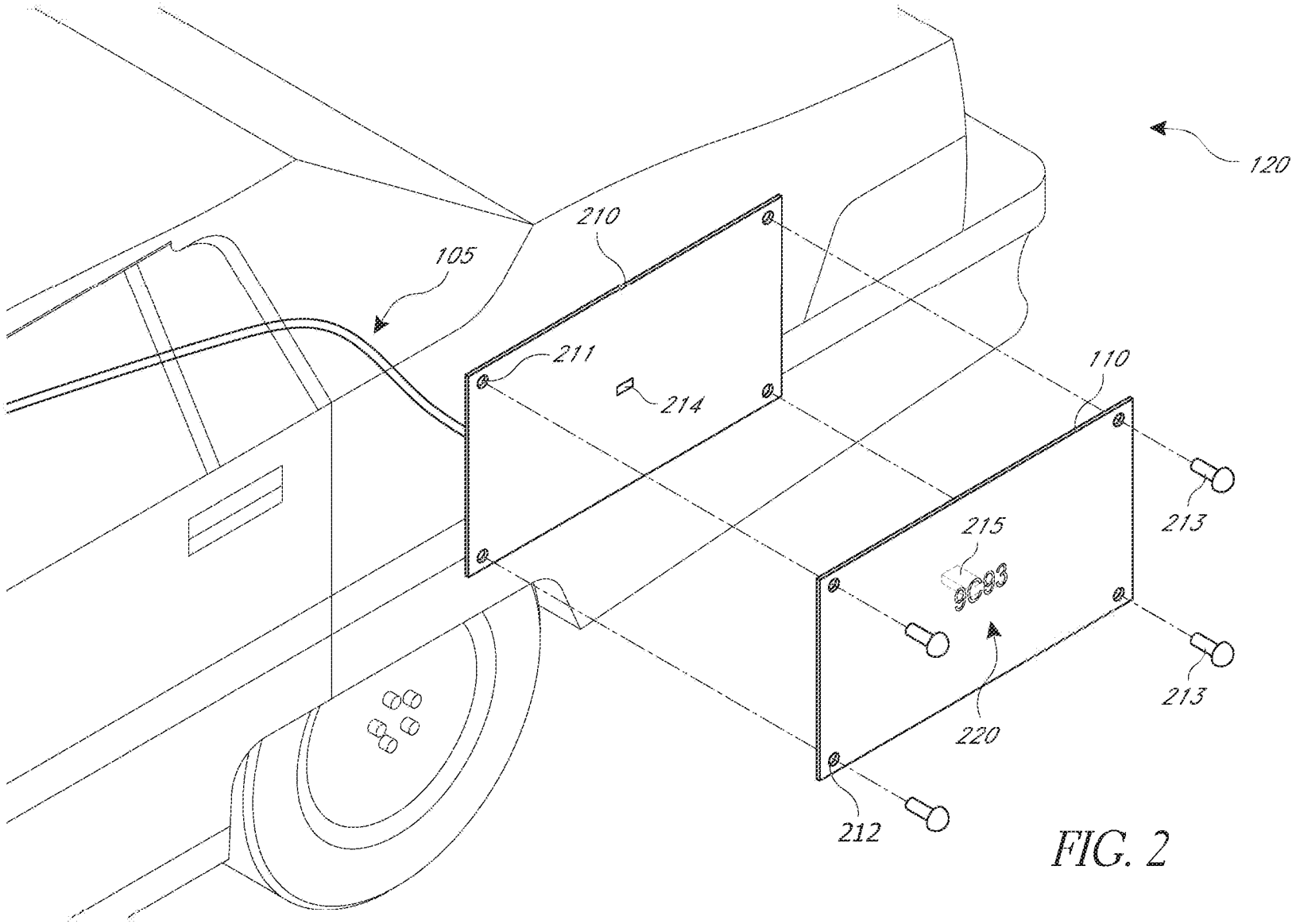
FIG. 2 shows one embodiment of medallion interfacing with a housing attached to a FHV.

FIG. 2 shows one embodiment of medallion 110 interfacing with housing 210. Housing 210, in the exemplar embodiment of FIG. 2, is positioned on the exterior of for-hire vehicle ("FHV") 120 along the rear driver's side of FHV 120. In some embodiments, medallion 110 may attach to housing 210 via bolts 213 that run through bolt holes 212 and attach to housing 210 via housing bolt holes 211. In other embodiments, medallion 110 may be attached to housing 210 via magnets or glue or epoxy. Those skilled in the art can appreciate that any suitable means for attaching two items may be used to connect medallion 110 to housing 210. Housing 210, in some embodiments, may also contain an attachment end point for connection 105, such as receptacle 214. Advantageously, receptacle 214 may be a USB Standard A or Standard B receptacle. Medallion 110 may be outfitted with a USB Standard A or Standard B plug, such as plug 215. Thus, when medallion 110 is attached to and engages with housing 210, plug 215 may be inserted into receptacle 214 thereby forming a connection between FHV Meter 100 and medallion 110. Advantageously, connection 105 allows for not only data transfer between FHV Meter 100 and medallion 110, but also power transfer so that medallion 110 may receive power.

In some embodiments, medallion 110 comprises display 220. In some embodiments, display 220 is used to indicate the medallion number or identifier of medallion 110. Display 220 may be static, that is, display may be permanently affixed to medallion 110. For example, medallion 110 may be made out of thin metal and display 220 may be raised and/or painted with a highlighted color, similar to a license plate. Display 220 may also be paint or a decal. In other embodiments, display 220 may be dynamic. For example, display 220 may be a small monitor or other changeable display that displays different medallion numbers at different times, such as for example, "9C93" at one time and "4A99" at a second time. In another embodiment, display 220 may turn to a single color indicating the operating status of FHV 120. For example, display 220 may illuminate green if FHV 120 is able to accept fares, or display 220 may flash red when FHV 120 may not be operable.

Figure 2A:
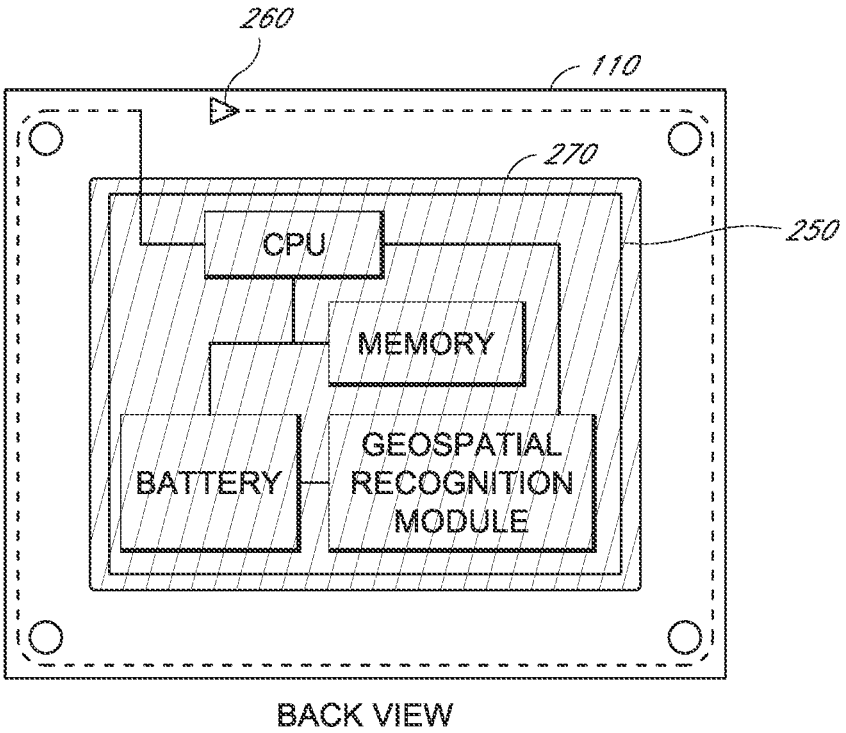
FIG. 2A shows one embodiment of a medallion with an attached transmitter.
Figure 2A:
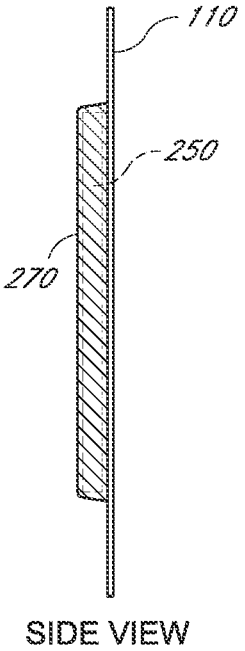

FIG. 2A is block diagram showing one embodiment of medallion 110. The exemplar embodiment of FIG. 2A shows two views of the embodiment of medallion 110, a back view and a side view. The back view shows a computer component 250 attached to medallion 110. The computer component may be a circuit board or integrated circuit containing a CPU, a memory, a battery and a geospatial recognition unit and one or more software modules as described with respect to FIG. 4. Advantageously, computer component 250 is relatively flat so that is may be attached to the back of medallion 110 and still allow medallion 110 to be connected to housing 210. Computer component 250 may be attached to medallion 110 with glue or epoxy 270. The epoxy advantageously covers computer component 250 thereby sealing it to the medallion. Tampering with computer component 250 may be deterred because removal of computer component 250 may require chipping at epoxy 270 which could potentially damage computer component 250. The side view of FIG. 2A shows medallion 110 with computer component 250 attached via epoxy. The exemplar embodiment of FIG. 2A also schematically shows a wireless transceiver and antenna 260. Wireless transceiver and antenna 260 may facilitate communication via connection 105 between medallion 110 and FHV meter 100. In the exemplar embodiment of FIG. 2A, the antenna is wrapped along the outside edge of medallion 110. The transmitter and receiver may be advantageously located on the computer component with the antenna extending to the outside surface of the medallion and properly insulated there from. One skilled in the art may appreciate that any placement of wireless transmitter and receiver along with the antenna may be used in order to facilitate proper communications with FHV meter 100, or central server 140.

Figure 3:
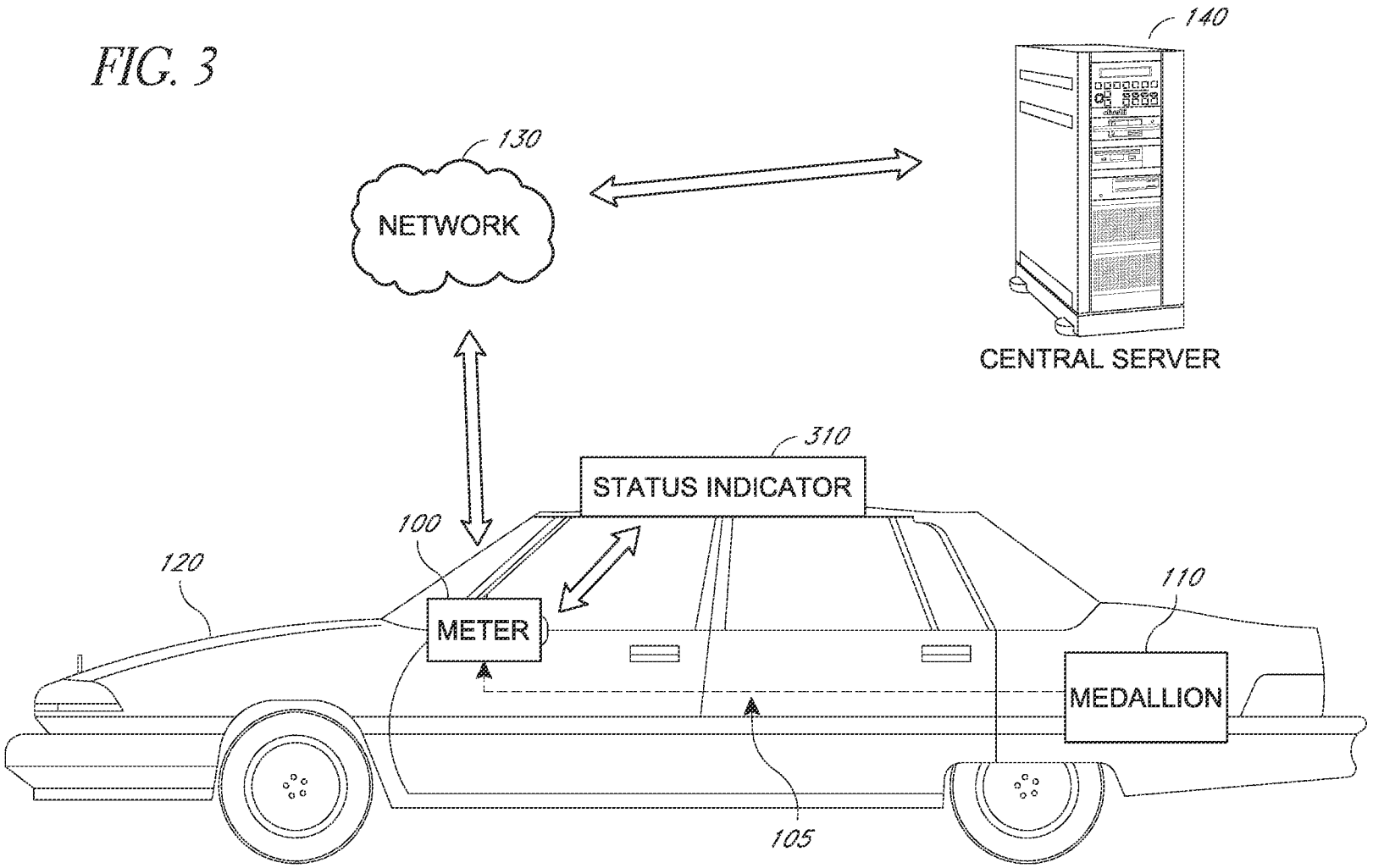
FIG. 3 is a block diagram showing one embodiment of a FHV comprising a FHV meter, a portable medallion, and a status indicator in communication with a central server over a network.

FIG. 3 is a block diagram showing one embodiment of FHV Meter 100 in communication with medallion 110, status indicator 310, network 130, and central server 140. In the exemplary embodiment of FIG. 3, medallion 110 is not affixed to the outside of the FHV, but rather, is a portable medallion that the driver of FHV may carry with him. A portable medallion may be useful in embodiments where a company operating for-hire vehicles has a fleet of FHVs operated by several drivers. A portable medallion may allow for drivers to operate different vehicles during different shifts. This may be useful, for example, if a driver's regular FHV needs repair, or if multiple drivers with different medallions operate the same FHV during different shifts. This may occur, for example, when a first medallion allows for operation of a FHV at night, while a second medallion allows for operation of a FHV during the day. If the fleet owner in this situation wishes to use one vehicle for the first and second medallions, a portable medallion may be advantageous.

In one embodiment, the portable medallion may be a wireless device that establishes communication with FHV Meter 100. It may, for example, be a programmable key fob. The key fob may advantageously include a RFID tag. The RFID tag may be programmed by the agency regulating FHVs with a medallion identification number or serial identifier that uniquely identifies the portable medallion. In such embodiments, FHV meter 100 may be outfitted with a RFID reader. In other embodiments, the portable medallion may be an application that executes on a portable device such as a cell phone, personal digital assistant, tablet computing device, etc. The application may, for example, contain software instructions that leverage the existing communications mechanism of the mobile device. For example, the application may use the device's existing Bluetooth or WiFi communications mechanisms in order to communicate with FHV Meter 100. In some embodiments, FHV Meter 100 may be Bluetooth or WiFi enabled in order to facilitate communications with portable medallion 110. In some embodiments, the communication between portable medallion and FHV Meter 100 are similar to, or the same as, that of an affixed medallion and FHV Meter 100 and are described in greater detail with respect to FIG. 5.

In some embodiments, medallion 110 may be a virtual medallion, that is it may be a file or software object that is programmed such that it may exist only in one location at a time. That is, before the medallion software object becomes active on any one device it checks the locations it has been active and does not activate if another instance of the medallion software object remains active. The virtual medallion may be uniquely located on FHV meter 100, or on a separate computing system such as a cell phone, PDS, tabled computing device, laptop, or any other portable computing system known in the art. Advantageously, the virtual medallion is programmed to communicate with the meter in a manner similar to that of a physical medallion by taking advantage of the most appropriate communication method available to the virtual medallion in its current location. For example, if the virtual medallion is uniquely located on a cell phone with WiFi it may take advantage of the WiFi capabilities to communicate with FHV Meter 100. The virtual medallion, in some embodiments, is located on a computer connected to central server 140. Central server 140 may execute a process that monitors the network for instances, or copies, of the virtual medallion. If the process detects more than one active virtual medallion, central server 140 may remove all but one instance of the virtual medallion it knows to be authorized to be active or it may remove all instances of the medallions. When all instances of medallions are removed FHV meter 100 would have be programmed with a new virtual medallion with the same ID, or be reconfigured to accept a new virtual medallion with a new ID.

In some embodiments, FHV Meter 100 may be attached to a status indicator 310 that is on the outside of FHV 120. Status indicator 310 may, for example, indicate a medallion status describing whether FHV 120 is operating with a valid medallion (i.e., a medallion is connected and it is the expected medallion). Status indicator 310 may be advantageous in embodiments employing a portable medallion because it may provide regulatory officers with a mechanism for quickly checking the medallion status of FHV 120 upon observation. In addition, the status indicator 310 may provide passengers with an indication if FHV 120 is a lawful FHV, that is, a FHV that is permitted to accept passengers and fares. The status indicator may indicate a first medallion status when a compliant medallion is connected to the meter and may indicate a second medallion status when a non-complaint medallion, or no medallion, is connected to the meter. For example, status indicator 310 may illuminate a green colored light when a compliant medallion is connected to FHV Meter 100 and may illuminate, or flash, a red colored light when a non-compliant medallion, or no medallion, is connected to FHV Meter 100. In other embodiments, status indicator 310 may comprise a monitor or other output device that allows for the display of text. For example, status indicator 310 may display the text "FOR HIRE" or "FARES ACCEPTED" if the meter is connected to a complaint medallion and "OUT OF SERVICE" or "FARES NOT ACCEPTED" if FHV Meter 100 is connected to a non-compliant medallion, or is not connected to any medallion at all.

In some embodiments, status indicator 310 may be a separate device affixed to the exterior of the car. For example, status indicator 310 may be a sign that sits on the roof of FHV 120 as shown in FIG. 3. In other embodiments, the status indicator may be affixed to the hood, side, or trunk of the FHV. In some embodiments, status indicator 310 may be part of FHV Meter 100. It may for example, be situated on FHV Meter 100 so that observers outside FHV 120 can view the medallion status of FHV 120. In some embodiments, status indicator 310 may also be situated so that passengers or outside observers may view the medallion status, or in other embodiments, FHV Meter 100 may contain two status indicators, one for exterior viewing of medallion status and one for interior viewing of medallion status. Status indicator may be color coded, that is, it may indicate a first color when a valid medallion is connected to FHV Meter 100 and it may indicate a second color when no medallion, or an invalid medallion, is connected to FHV Meter 100. In other embodiments, status indicator 310 may display a first message such as "MEDALLION VALID" when a valid medallion is connected to FHV Meter 100, or it may display a second message such as "THIS VEHICLE CANNOT LEGALLY ACCEPT FARES." Messages may be advantageous to advise passengers as to which FHVs are operating legally and which are not. In some embodiments, status indicator 310 may produce an audible sound, such as a beep or recorded message when no medallion, or an invalid medallion, is connected to FHV Meter 100.

In other embodiments, the status indicator may be part of a medallion affixed to FHV 120 as opposed to a separate device or part of FHV Meter 100. In such embodiments, the medallion may be affixed to the exterior of the FHV or the interior of the FHV where it may be viewed from the exterior or interior of the FHV.

Figure 4:
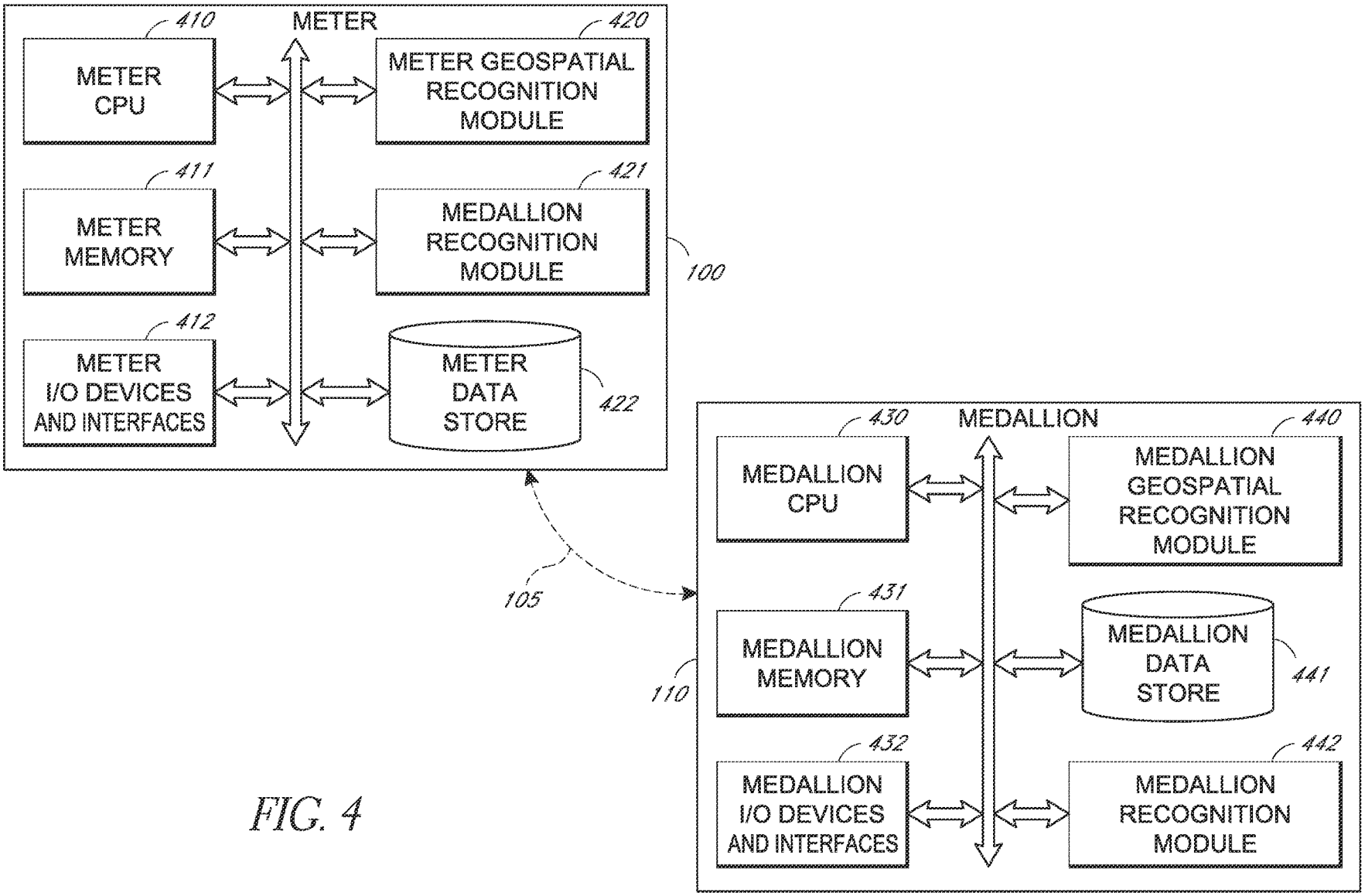
FIG. 4 is a block diagram showing one embodiment of a FHV Meter in communication with one embodiment of a medallion.

FIG. 4 is a block diagram showing one embodiment of FHV Meter 100 in communication with one embodiment of medallion 110. In one embodiment, FHV Meter 100 may be a dedicated computing device that attaches to, or on, FHV 120 and has external interfaces for communicating with other computer systems attached to, on, or in FHV 120. In other embodiments, FHV Meter 100 may be a separate computing module that is part of the existing computer system of FHV 120. In such embodiments, FHV Meter 100 may be not be visible from within the interior of FHV 120, and FHV Meter 100 may make use of existing input/output devices of FHV 120 for displaying information, such as fare information, or medallion status information, to the driver and passenger of FHV 120. In some embodiments, FHV Meter 100 may communicate with medallion 110 via connection 105.

In one embodiment, FHV Meter 100 is configured to interface with multiple devices and/or data sources, such as in the exemplary network of FIG. 1. FHV Meter 100 may be used to implement certain systems and methods described herein. For example, in one embodiment, FHV Meter 100 may be configured to calculate fares for passengers that hire for-hire vehicles ("FHVs"). The functionality provided for in the components and modules of FHV Meter 100 may be combined into fewer components and modules or further separated into additional components and modules.

In general, the word module, as used herein, refers to logic embodied in hardware or firmware, or to a collection of software instructions stored on a non-transitory, tangible computer-readable medium, possibly having entry and exit points, written in a programming language, such as, for example, C, C++, C#, or Java. A software module may be compiled and linked into an executable program, installed in a dynamic link library, or may be written in an interpreted programming language such as, for example, BASIC, Perl, or Python. It will be appreciated that software modules may be callable from other modules or from themselves, and/or may be invoked in response to detected events or interrupts. Software modules may be stored in any type of computer-readable medium, such as a memory device (e.g., random access, flash memory, and the like), an optical medium (e.g., a CD, DVD, BluRay, and the like), firmware (e.g., an EPROM), or any other storage medium. The software modules may be configured for execution by one or more CPUs in order to cause FHV Meter 100 to perform particular operations.

It will be further appreciated that hardware modules may be comprised of connected logic units, such as gates and flip-flops, and/or may be comprised of programmable units, such as programmable gate arrays or processors. The modules described herein are preferably implemented as software modules, but may be represented in hardware or firmware. Generally, the modules described herein refer to logical modules that may be combined with other modules or divided into sub-modules despite their physical organization or storage In one embodiment, FHV Meter 100 includes a dedicated computer that is IBM, Macintosh or Linux/Unix compatible. In another embodiment, FHV Meter 100 may be a customized computing device configured only to operate as a meter in a for-hire vehicle. In another embodiment, FHV Meter 100 may be a module that is part of the internal computing system of the for-hire vehicle. FHV Meter 100 may, in some embodiments, include one or more central processing units ("Meter CPU") 410, which may include one or more conventional or proprietary microprocessors. FHV Meter 100 may further include meter memory 411, such as random access memory ("RAM") for temporary storage of information and read only memory ("ROM") for permanent storage of information, and meter data store 422, such as a hard drive, diskette, or optical media storage device. In certain embodiments, meter data store 422 stores data needed for the basic functioning of FHV Meter 100. In other embodiments, meter data store 422 might store historical trip information. Embodiments of meter data store 422 may store data in databases, flat files, spreadsheets, or any other data structure known in the art. Typically, the modules of FHV Meter 100 are in communication with one another via a standards based bus system. In different embodiments, the standards based bus system could be Peripheral Component Interconnect (PCI), Microchannel, SCSI, Industrial Standard Architecture (ISA) and Extended ISA (EISA) architectures, for example. In another embodiment, FHV Meter 100 leverages computing and storage services available over the Internet (cloud computing).

In one embodiment, data store 422 contains a data structure, or data element, that identifies the embodiment of medallion 110 associated with it. In some embodiments, the data element may be an integer that represents the serial number, medallion number, serial identifier, or other numeric value that could be used to uniquely identify medallion 110. In other embodiments, the data element may be a string or character array that is unique to medallion 110. For example, example, the data element might be 12345678 or "09GTR67RXY." In other embodiments, the unique identifier may be an object or a data structure with several elements that when combined represent a unique identifier for the medallion. For example, the medallion number combined with information regarding the operational scope of the medallion may be combined to uniquely represent the medallion.

FHV Meter 100 is generally controlled and coordinated by operating system software, such as the Windows 95, 98, NT, 2000, XP, Vista, Linux, SunOS, Solaris, PalmOS, Blackberry OS, or other compatible operating systems. In Macintosh systems, the operating system may be any available operating system, such as MAC OS X. In another embodiment, FHV Meter 100 may be controlled by a proprietary operating system. Conventional operating systems control and schedule computer processes for execution, perform memory management, provide file system, networking, and I/O services, and may provide a user interface, such as a graphical user interface ("GUI") for display, among other things.

FHV Meter 100 may include one or more commonly available I/O devices and interfaces 412, such as for example, a printer, buttons, a keyboard, a LED display, a monitor, a touchpad, touchscreen, a USB port, a RS 232 port and the like. In one embodiment, I/O devices and interfaces 412 include one or more display devices, such as a monitor, that allows the visual presentation of data, such as medallion status data, to a user. In the embodiment of FIG. 4, I/O devices and interfaces 412 provide a communication interface to various external devices. For example, in this embodiment FHV Meter 100 is in communication with a medallion, via a wired or wireless connection via an interface of I/O devices and interfaces 412. The communications interface may also include, for example, ports for sending and receiving data such as a USB port or an RS 232 port. In other embodiments, I/O devices and interfaces 412 may communicate via Bluetooth or IEEE 802.11. In some embodiments, FHV Meter 100 may communicate with one or more external devices such as the computer system of FHV 120, a printer, a GPS device, etc. by sending and receiving data on ports such as a USB port or a RS 232 port.

In one embodiment, FHV Meter 100 may have meter geospatial recognition module 420. Geospatial recognition module 420 may include a GPS receiver for receiving GPS coordinates from GPS satellites. In some embodiments, the GPS coordinates received from geospatial recognition module 420 may used to determine the location of FHV Meter 100 which then may be sent to central server for processing.

FHV Meter 100 may include, in some embodiments, medallion recognition module 421. Medallion recognition module 421 may include software instructions used to process data received from medallion 110 via I/O interfaces and devices 412. For example, medallion recognition module 421 may include software instructions that cause meter CPU 410 to perform the steps described in conjunction with FIG. 5. In some embodiments, medallion recognition module 421 may also comprise software instructions that allow FHV Meter 100 to determine the distance between medallion 110 and FHV Meter 100. For example, medallion recognition module 421 may rely on the amount of time it takes a test signal to be sent and received from medallion based on the implementation of connection (such as for example, RF, Bluetooth, IEEE 802.11, etc.). In another embodiment, medallion recognition module 421 may comprise code that determines whether a medallion is connected to FHV Meter 100 via connection 105. In such embodiments, medallion recognition module 421 may leverage the limitations of connection in order to ensure that medallion is within a close proximity to FHV Meter 100. For example, if connection 105 is implemented via Class 2 Bluetooth, medallion recognition module 421 would be unable to detect medallions beyond approximately 10 meters. Thus, medallion recognition module 421 may not attempt to detect the distance between FHV Meter 100 and medallion 110, but rather, would process all medallion signals it may receive over connection and determine if the medallion sending the signal matches the expected identification description stored in data store. Advantageously, FHV Meter 100 polls for its associated medallion on a periodic basis. For example, FHV Meter 100 may search for its associated medallion every 15 minutes, every thirty minutes, or every hour. FHV Meter 100 may also poll on a near continuous basis. For example, code handling the polling function of FHV Meter 100 may run in a dedicated execution thread that is part of an infinite loop checking to determine of the meter's associated medallion is within the appropriate distance.

FIG. 4 also shows one embodiment of a medallion. The medallion of FIG. 4 may be considered a "smart medallion," that is, it contains a processor ("CPU") and memory allowing for processing and active communications to occur with FHV Meter 100. The medallion of FIG. 4 may include medallion CPU 430, medallion memory 431, medallion I/O devices and interfaces 432, medallion geospatial recognition module 440 and medallion data store 441. In virtual medallion embodiments, the components shown in FIG. 4 may be part of a larger system in which the virtual medallion is uniquely located. For example, if the virtual medallion is uniquely located on a smart phone, CPU 430, medallion memory 431, medallion I/O devices and interfaces 432, medallion geospatial recognition module 440 and medallion data store 441 would be the CPU, memory, I/O devices and interfaces, geospatial recognition module and data store of the smart phone.

In one embodiment, the exemplary medallion of FIG. 4 includes one or more CPUs, which may include one or more conventional or proprietary microprocessors. Medallion 110 further includes a memory, such as random access memory ("RAM") for temporary storage of information and a read only memory ("ROM") for permanent storage of information, and a data store 441, such as a hard drive, diskette, flash memory, or optical media storage device. Embodiments of data store 441 may store data in databases, flat files, spreadsheets, or any other data structure known in the art. Typically, the modules of medallion 110 are in communication with one another via a standards based bus system. In different embodiments, the standards based bus system could be Peripheral Component Interconnect (PCI), Microchannel, SCSI, Industrial Standard Architecture (ISA) and Extended ISA (EISA) architectures, for example.

In one embodiment, data store contains a data structure, or data element, that identifies medallion 110. In some embodiments, the data element may be an integer that represents the serial number, medallion number, or other numeric value that could be used to uniquely identify medallion 110. In other embodiments, the data element may be a string or character array that is unique to medallion 110. For example, example, the data element might be 12345678 or "09GTR67RXY." In other embodiments, the unique identifier may be an object or a data structure with several elements that when combined represent a unique identifier for the medallion 110. For example, the medallion number combined with information regarding the operational scope of the medallion may be combined to uniquely represent the medallion.

In some embodiments, medallion 110 may be a dedicated computing device, that is, medallion 110 be configured to operate as a medallion in systems such as the system of FIG. 1, but may be incapable of operating as a general purpose computing device. In other embodiments, medallion may be a general computing device such as a PC, laptop, tablet, cell phone, mobile device, personal digital assistant, etc. Medallion may be generally controlled and coordinated by operating system and/or server software, such as the Windows 95, 98, NT, 2000, XP, Vista, Linux, SunOS, Solaris, PalmOS, Blackberry OS, Apple iOS (iPhone Operating System), Android or other compatible operating systems. For cell phones or other mobile devices, the operating system may be a proprietary operating system designed for use with that mobile device. Conventional operating systems control and schedule computer processes for execution, perform memory management, provide file system, networking, and I/O services, and provide a user interface, such as a graphical user interface ("GUI"), among other things.

Medallion 110 may include one or more commonly available I/O devices and interfaces 432, such as for example, a keyboard, a LED display, a touchpad, touchscreen, a USB port, a RS 232 port and the like. In one embodiment, I/O devices and interfaces 432 include one or more display devices, such as a monitor, that allows the visual presentation of data, such as medallion connection data, to a user. In the embodiment of FIG. 4, I/O devices and interfaces 432 provide a communication interface to various external devices. For example, in the embodiment of FIG. 4 medallion is in communication with FHV Meter 100, via a wired, wireless, or combination of wired and wireless, connections via an interface of I/O devices and interfaces 432. The communications interface may also include, for example, ports for sending and receiving data such as a USB port or an RS 232 port. In other embodiments, I/O devices and interfaces 432 may communicate via Bluetooth or IEEE 802.11. In some embodiments, medallion 110 may communicate with one or more external devices such as the FHV internal computer system, a printer, a GPS device, etc. by sending and receiving data on ports such as a USB port or a RS 232 port.

In the embodiment of FIG. 4, medallion also includes several application modules that may be executed by medallion CPU 430. The software code of the modules may be stored on a non-transitory computer-readable medium such as for example, RAM or ROM. More particularly, the application modules include medallion geospatial recognition module 440 and ID reporting module 442. Geospatial recognition module 440 may include a GPS receiver for receiving GPS coordinates from GPS satellites. In some embodiments, the GPS coordinates received from geospatial recognition module 440 may used to determine the location of medallion 110 which may be sent to central server for processing, or in other embodiments, communicated to FHV Meter 100 via connection 105. ID reporting module 442 may include software instructions that report the ID of the medallion to FHV Meter 100. For example, ID reporting module 442 may comprise software instructions that respond to a request sent by FHV Meter 100 to medallion 110 for the identification data stored in medallion data store 441. In some embodiments, ID reporting module 442 may access the identification data stored in medallion data store 441 and format it before sending the data to FHV Meter 100. For example, if the identification data is to be sent as a serialized object, ID reporting module 412 may extract from data store the parameters defining the object and serialize the object before transmitting it to FHV Meter 100. In some embodiments, ID reporting module may be programmed to broadcast the ID of medallion 110 over its communications port on a periodic basis. For example, ID reporting module may broadcast is identification message every second or minute, or every 5, 10 or 15 minutes.

Figure 5:
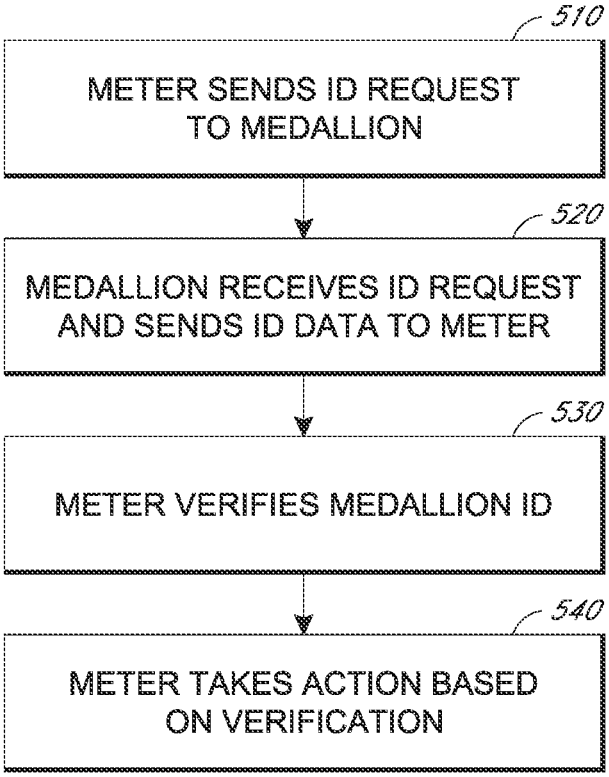
FIG. 5 is a flow chart describing one method communication between a FHV Meter and a medallion.

FIG. 5 is a flow chart describing one method communication between FHV Meter 100 and medallion 110. The flow chart of FIG. 5 is meant as an example of the communications between FHV Meter 100 and medallion 110, however, other communications may be appropriate in varying embodiments.

Staring in box 510, FHV Meter 100 may send a request to medallion 110 for its identification data. The FHV Meter 100 may send this request on a periodic basis such as, for example, every minute, every 15 minutes, every 30 minutes, etc. The ID request may be sent via connection 105. In embodiments where connection is a wired connection, the request may be sent to the port of FHV Meter 100 where connection 105 is connected to FHV Meter 100 so that the request is transferred across connection 105. In other embodiments, where connection is wireless, FHV Meter 100 may open a port via software instructions stored on FHV Meter 100 in order to establish wireless communication with medallion. The request may be, in some embodiments, a preformatted message or byte stream that provides an indication that medallion should send its identification information to FHV Meter 100. In some embodiments, the identification request may contain response data so that medallion 110 may effectuate a response. For example, in an embodiment where connection is wireless and implemented via IEEE 802.11, the identification request may comprise the IP and port information of FHV Meter 100 so that medallion 110 can establish a connection with FHV Meter 100.

In box 520, medallion 110 receives the identification request and in response sends the appropriate identification data to requesting FHV Meter 100. In embodiments where the request contains FHV Meter 100 communication data, medallion 110 may establish communication with FHV Meter 100 according to the communication data.

In box 530, FHV Meter 100 receives the identification data from medallion. FHV Meter 100 will then verify the identification data to ensure that received data is from the appropriate medallion. In some embodiments, this may be done by comparing the received identification data with the expected medallion identification data stored in data store. Then, in box 540, the meter takes action based upon the results of the verification.

In some embodiments, if the received medallion identification data matches the expected medallion identification data, the FHV Meter 100 starts, or continues operation. Operation may include, for example, calculating fares, accepting payment from passengers, illuminating signage (such as for hire signage) on the exterior of the vehicle, etc. FHV Meter 100 may also communicate with central server 140 upon verification of identification data in order to update the connection status of the FHV Meter 100. If, however, the received medallion identification data does match the expected identification data, FHV Meter 100 may, in some embodiments, cease operation. In some embodiments, ceasing operation may include, for example, powering down FHV Meter 100, failing to collect fares, failing to process payments, turning off sign illuminations, etc. In other embodiments, FHV Meter 100 may be connected to the FHV's internal computer system and when a medallion fails verification, it may, for example, cause the vehicle not to start. In other embodiments, FHV Meter 100 may send a message to a reporting computer system such as central server 140 indicating that verification of the licensing medallion failed. This may result in the reporting computer system generating an alert message, or in other embodiments, sending a kill message t to FHV Meter 100. The kill message may cause FHV Meter 100 to immediately power down, or in other embodiments, may allow the meter to continue with an existing fare paying passenger, but then once that passenger has paid and the fare is closed out on the meter, the kill message may advantageously not allow FHV Meter 100 to become first engaged until FHV Meter 100 returns to compliance.

Figure 5A:
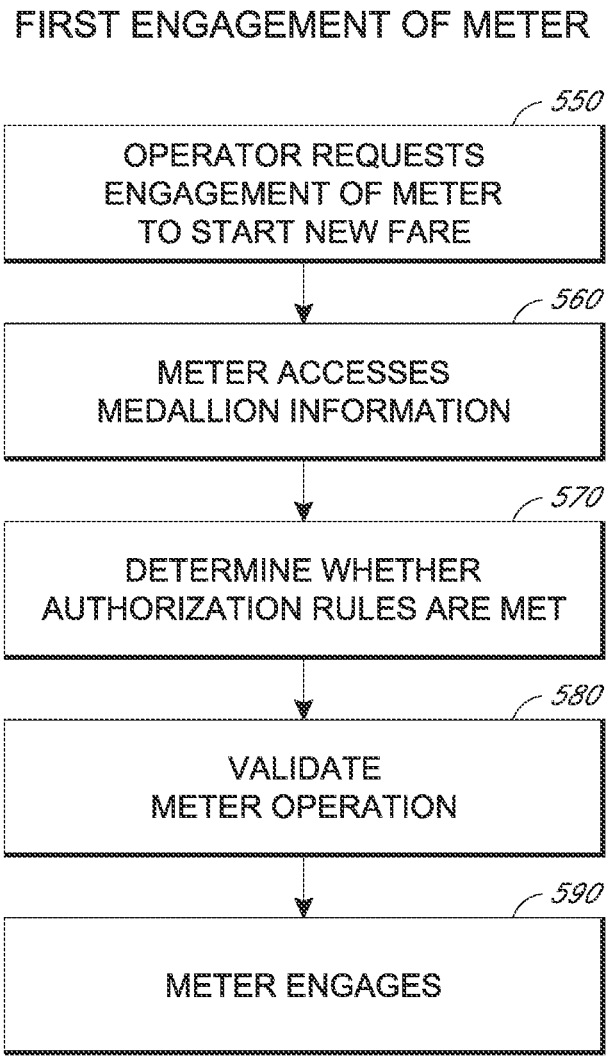
FIG. 5A is a flow chart describing one method of first engagement of a meter.

FIG. 5A is a flow chart describing one embodiment of the first engagement of a FHV Meter. When a passenger hires FHV 120, the operator of FHV 120 may attempt to engage FHV Meter 100 to start a fare for that passenger at box 550. The operator may press a button or turn a dial on FHV Meter 100 that will create a signal within FHV meter to start the fare. In box 550, FHV Meter 100 accesses the medallion information from medallion 110. In some embodiments, FHV Meter 100 accesses the medallion information from medallion 110 over connection 105.

At box 570, a determination is made as to whether the authorization rules are met. In one embodiment, medallion 110 determines if it is within its authorization. This may be done by verifying that the medallion's current state falls within authorization rules programmed in medallion 110. In some embodiments, medallion 110 provides authorization to operate FHV 120 twenty-four hours a day, seven days a week and for all regions within the jurisdiction. In such embodiments, processing moves to box 570. In other embodiments, where medallion 110, or its associated certificate, restricts the use of the FHV to certain times or geographic locations, medallion 110 must determine its current state. Advantageously, medallion 110 determines its state via geospatial recognition module 440. From geospatial recognition module 440, medallion 110 may determine its current location and the current time. Medallion 110 then processes its current state by comparing the current state to its authorization rules. For example, if medallion 110 only, or the associated CCPN of the FHV, authorizes pick-ups, i.e., first engagement of its associate meter, on the south side of the jurisdiction, medallion 110 may be programmed with a set of authorization rules defining the boundaries of the south side of the jurisdiction. For example, the boundaries may be GPS coordinates defining the boundaries, or they may be landmarks such as roads or railway tracks. Once medallion 110 determines its current location, it can compare the current location to the boundaries and determine if it is currently within its boundaries.

In other embodiments, the determination of whether authorization rules are met may be performed by FHV Meter 100. In such embodiments, FHV Meter 100 may access authorization rules from central server 140. Once FHV Meter 100 has accessed medallion information at box 560, it may then send some of that medallion information to central server 140 and request the authorization rules associated with the medallion and certificate. Central server 140 may then send the rules back to the meter. FHV Meter 100 may then determine its current state, such as location and time, and compare it to the authorization rules it received from central server 140. FHV Meter may then determine whether the authorization rules are met.

In other embodiments, FHV Meter 100 may be programmed with a data table including every medallion in the jurisdiction along with the medallion's associated authorization rules, including certificate restrictions. In such embodiments, once FHV Meter 100 accesses the medallion information, it may then look up the authorization rules based on the medallion information. Once it has found the appropriate authorization rules, it may then determine whether its current state meets the authorization rules. FHV Meter 100 may be programmed with a secure data packet as described in application Ser. No. 13/116,856. For example, the data table may be formatted as an XML file, text file, or data object that is then encrypted along with FHV Meter 100's other operating parameters, and then sent to FHV Meter 100.

In other embodiments, central server 140 may determine whether authorization rules are met. In such embodiments, FHV Meter 100 may send a first engagement request message to central server 140. Advantageously, the first engagement request message contains the serial number or unique identifier of FHV Meter 100, the medallion number or serial identifier of the medallion, the current state of FHV Meter (location and time, for example) and an indication that FHV Meter 100 wishes to become first engaged. The central server may then look up the authorization rules associated with the received medallion number and compare them to the received current state of FHV Meter 100 to determine whether the authorization rules are met.

In box 580, FHV Meter 100 operation is validated. In embodiments where the medallion determines if the authorization rules are met, if the current state determined by the medallion falls within its authorization rules, medallion 110 sends a message to FHV meter 100 indicating that it is OK to engage. If, on the other hand, the current state does not fall within the authorization rules, then medallion 110 will send a message to FHV Meter 100 not to engage. For example, medallion 110 may only provide authorization to FHV to pick up passengers on the weekend. Medallion 110 may check the current state and determine that the current day is Saturday. Medallion 110 will then send a message to FHV meter 100 indicating that is OK to engage. If, however, medallion 110 determined the current day was Wednesday, then medallion 110 would send a message to FHV meter 100 that is not OK to engage. In embodiments where central server 140 determines whether authorization rules are met, it may perform a similar validate meter operation; central server 140 may send a message to FHV Meter 100 indicating that it is OK to engage if it determines the authorization rules are met, and may send a message not to engage if the authorization rules are not met. In other embodiments, where FHV Meter 100 determines if the authorization rules are met, the meter will determine whether to it allow itself to become first engaged in a similar manner.

In box 590, once FHV meter 100 receives an OK to engage message, it engages the fare. In some embodiments, FHV meter 100 will not operate until an OK to engage message is received from medallion 110. Once FHV Meter 100 engages, it will continue to operate until the fare is over. Thus, once first engaged, a FHV Meter 100 and medallion 110 pair may operate outside the pick-up (first engagement) authorization of medallion 110, but once the fare is over, FHV meter 100 will not engage again unless FHV 120 returns to a state for which medallion 110 has given it authorization. For example, medallion 110 may only permit FHV Meter 100 to accept fares between 6 PM and 6 AM. If a passenger wishes to hire a FHV at 5:30 am, the FHV meter will engage since 5:30 am is within medallion 110's authorization. If the trip lasts until 6:13 am, the fare may be completed. Once the passenger is dropped off, FHV meter 100 will not engage again until 6 PM so long as FHV Meter 100 remains associated with medallion 110. In this way, the medallion or certificate restrictions, or authorization rules, may be enforced automatically by checking the medallion restrictions when the FHV Meter 100 is to be first engaged with a new fare. This may significantly decrease or even eliminate the need for active enforcement of medallion, or certificate, rules within a jurisdiction. As well, this will effectively mete out FHV services to areas and times that the regulatory agency has determined are in the best interests of the riding public.

Figure 6:
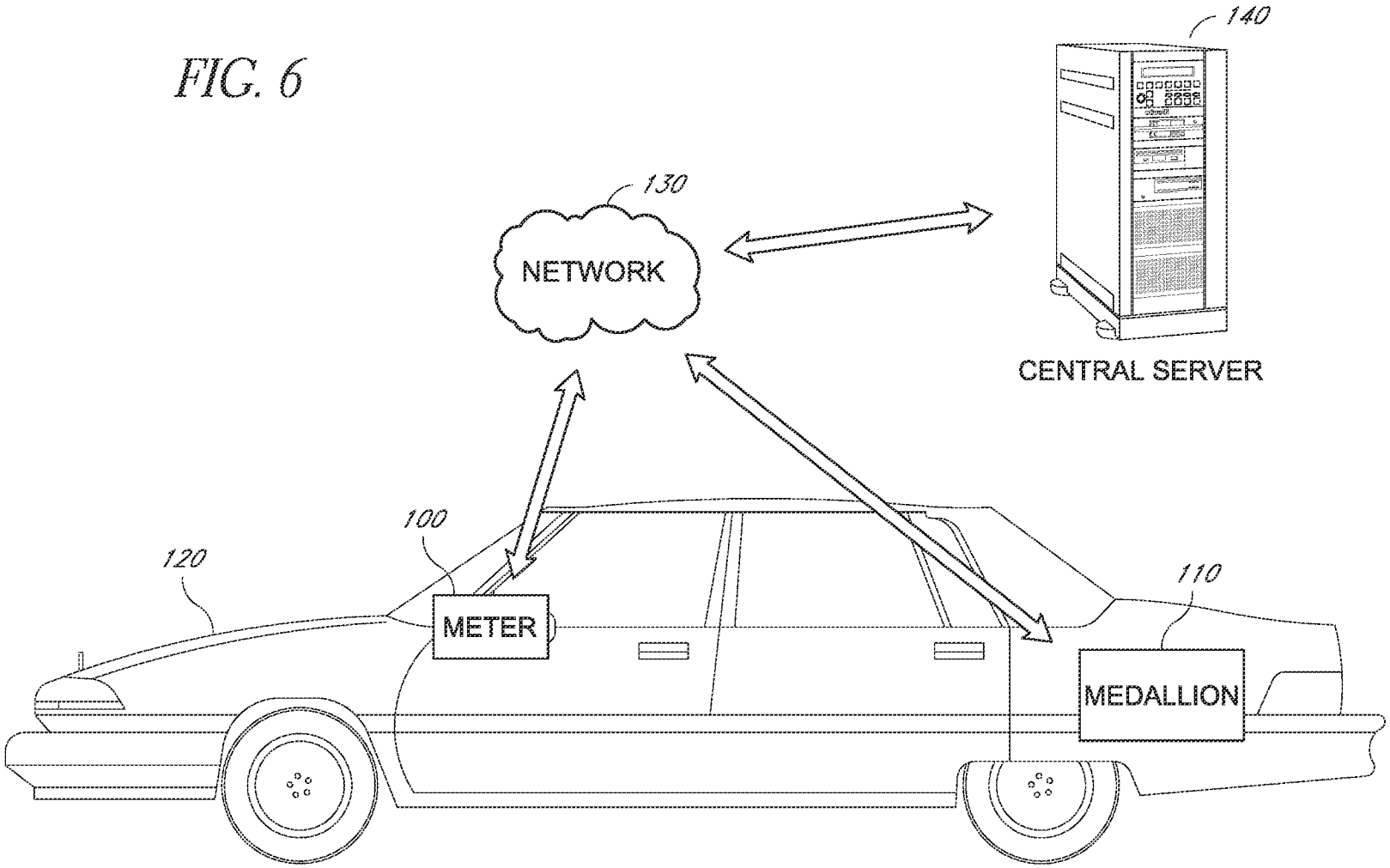
FIG. 6 shows one embodiment of a FHV Meter, a medallion and a central server in communication over a network

FIG. 6 shows one embodiment of a FHV Meter 100, medallion 110 and central server 140 in communication over network 130. In the embodiment of FIG. 6, FHV Meter 100 and medallion 110 are not connected to one another; rather, each is connected to central server 140. Central server 140 may receive identification and location data of FHV Meter 100 and medallion 110 and it may then determine FHV Meter 100 and medallion 110 are close enough together to ensure that the correct FHV Meter 100 is operating with the correct medallion 110. The method for verifying FHV Meter 100 and medallion 110 for compliance for an FHV is set forth in FIG. 11.

Figure 7:
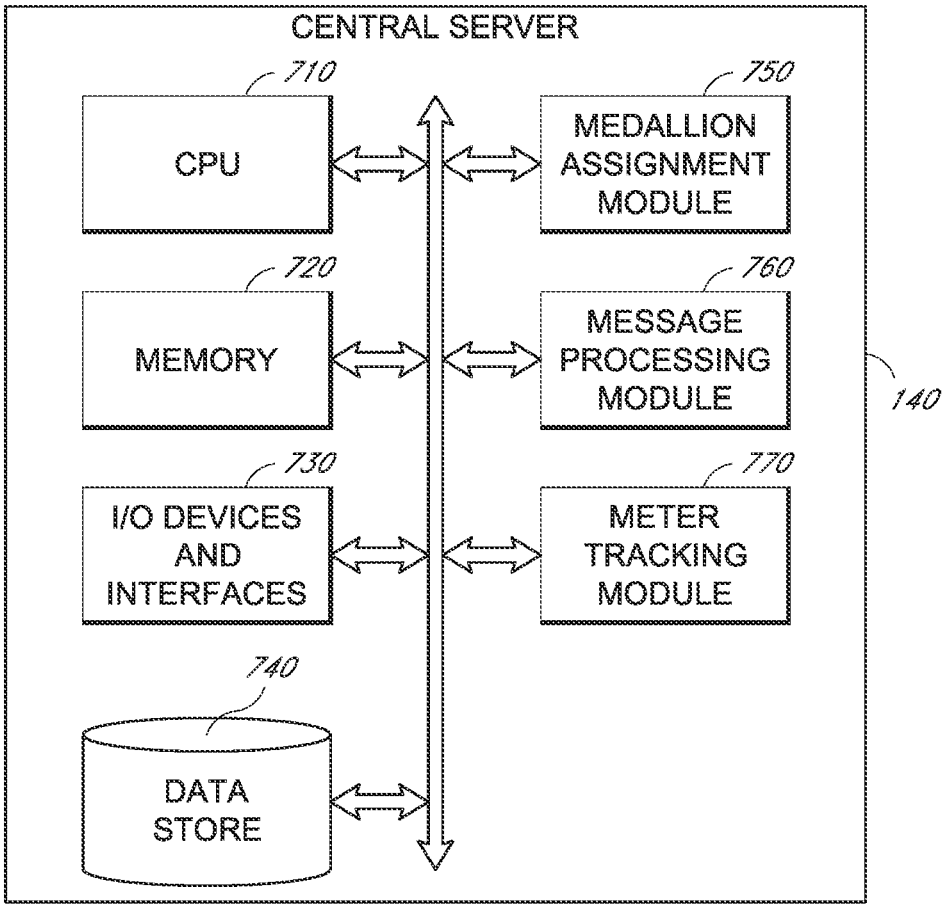
FIG. 7 is a block diagram of one embodiment of a central server.

FIG. 7 is a block diagram of one embodiment of central server 140. In one embodiment, central server 140 is configured to interface with multiple devices, such as shown in the exemplary network of FIG. 1. Central server 140 may be used to implement certain systems and methods described herein. The functionality provided for in the components and modules of central server 140 may be combined into fewer components and modules, or further separated into additional components and modules In one embodiment, central server 140 includes, for example, a server or a personal computer that is IBM, Macintosh, or Linux/Unix compatible. In another embodiment, central server comprises a laptop computer, smart phone, personal digital assistant, or other computing device, for example. In one embodiment, the exemplary central server of FIG. 7 includes one or more central processing units ("CPU") 710, which may include one or more conventional or proprietary microprocessors. Central server 140 further includes memory 720, such as random access memory ("RAM") for temporary storage of information and a read only memory ("ROM") for permanent storage of information, and a data store 740, such as a hard drive, diskette, or optical media storage device. In certain embodiments, data store 740 stores the association between FHV Meters and medallions ("medallion-meter pairs") under the control of the regulatory agency. Embodiments of data store 740 may store data in databases, flat files, spreadsheets, or any other data structure known in the art. Typically, the modules of central server 140 are in communication with one another via a standards based bus system. In different embodiments, the standards based bus system could be Peripheral Component Interconnect (PCI), Microchannel, SCSI, Industrial Standard Architecture (ISA) and Extended ISA (EISA) architectures, for example. In another embodiment, central server 140 leverages computing and storage services available over the Internet (cloud computing).

Central server 140 is generally controlled and coordinated by operating system and/or server software, such as the Windows 95, 98, NT, 2000, XP, Vista, Linux, SunOS, Solaris, PalmOS, Blackberry OS, or other compatible operating systems. In Macintosh systems, the operating system may be any available operating system, such as MAC OS X. In another embodiment, central server 140 may be controlled by a proprietary operating system. Conventional operating systems control and schedule computer processes for execution, perform memory management, provide file system, networking, and I/O services, and provide a user interface, such as a graphical user interface ("GUI"), among other things.

The exemplary central server may include one or more commonly available input/output (I/O) interfaces and devices 730, such as a keyboard, mouse, touchpad, and printer. In one embodiment, the I/O devices and interfaces 730 include one or more display devices, such as a monitor, that allows the visual presentation of data to a user. More particularly, a display device provides for the presentation of GUIs, application software data, and multimedia presentations, for example. In the embodiment of FIG. 7, I/O devices and interfaces 730 provide a communication interface to various external devices. For example, in this embodiment central server 140 is in communication with network 130, such as any combination of one or more LANs, WANs, or the Internet, for example, via a wired, wireless, or combination of wired and wireless, connections via a network interface of the I/O devices and interfaces 730.

In the embodiment of FIG. 7, central server 140 also includes several application modules that may be executed by CPU 710. The software code of the modules may be stored on a non-transitory computer-readable medium such as for example, RAM or ROM. More particularly, the application modules include medallion assignment module 750, message processing module 760, and meter tracking module 770. In some embodiments, central server 140 may be operated by a regulatory agency, or in some embodiments, by a FHV fleet operator under the supervision of a regulatory agency. Central server 140 may, in some embodiments, be secured via a username and password. In other embodiments, central server 140 may be located in physically secure location such that only authorized personnel may access central server 140.

Central server 140 may include, in some embodiments, medallion assignment module 750. Medallion assignment module 750 may comprise software code executable by CPU 710 that handles the assignment of medallions to FHV meters and FHVs. In some embodiments, medallion assignment module 750 may generate a user interface, such as create new assignment user interface 950, that allows an operator of central server 140 to associate medallions with FHV meters. Medallion assignment module 750 may also generate current assignments user interface 910 that displays on a monitor of I/O devices 730 a list of current meter and medallion assignments. Medallion assignment module 750 may interface with data store 740 in order to store new meter and medallion assignments for later retrieval or for processing by other modules such as message processing module 760 or meter tracking module 770. Medallion assignment module 750 may store data related to the medallion-meter assignment. For example, it may store the name of the owner of the medallion, the operator of the medallion, the medallion number, the medallion associated with the medallion number, a VIN number of a FHV assigned to the medallion-meter pair, or other data that may be necessary to store with respect to a medallion as prescribed by the regulations put in place by the regulatory agency controlling central server 140. Medallion assignment module 750 may also store a set of one or more VIN numbers associated with a medallion. This advantageously allows the owner of one medallion to apply the medallion to more than one vehicle in jurisdictions that allow such a practice. In such embodiments, the medallion may only be assigned to one VIN at a time, however, medallion assignment module 750 may persist an association between a group of VINs each of which may be temporarily assigned to a medallion during mutually exclusive time periods. In addition to or instead of using VIN numbers other ways of uniquely identifying the vehicle or vehicles that may be used with any one medallion are contemplated. Further, a company may be identified that is authorized to assign a vehicle to a medallion instead of or in addition to a plurality of VIN numbers.

In one embodiment, message processing module 760 may comprise software code executable by CPU 710 that handles processing of messages received from FHV Meter 100 and medallion 110. For example, message processing module 760 may process messages indicating that FHV Meter 100 has established communication with a medallion or that FHV Meter 100 has lost communication with a medallion. In some embodiments, message processing module 760 may record messages in data store 740. In other embodiments, message processing module 760 may process messages by extracting data from messages received by central server 140 from FHV Meter 100, medallion, or other devices such as meter detection unit 1200 and/or medallion detection unit 1210.

In other embodiments, message processing module 760 may receive messages from FHV Meter 100 communicating the medallion status of FHV Meter 100. This may occur in embodiments where FHV Meter 100 verifies its own status such as the exemplary embodiment depicted in FIG. 1. The messages may include, for example, a FHV Meter 100 ID that uniquely identifies the meter (for example, a serial number or regulatory agency assigned number or character string), a status indicating whether FHV Meter 100 is in operation, a status indicating whether FHV Meter 100 is connected to medallion 110, a status indicating whether the FHV meter 100 is connected to its assigned medallion ID, or any other data collected or stored by FHV meter 100 that a person with ordinary skill in the art may think is of interest to central server 140.

Figure 11:
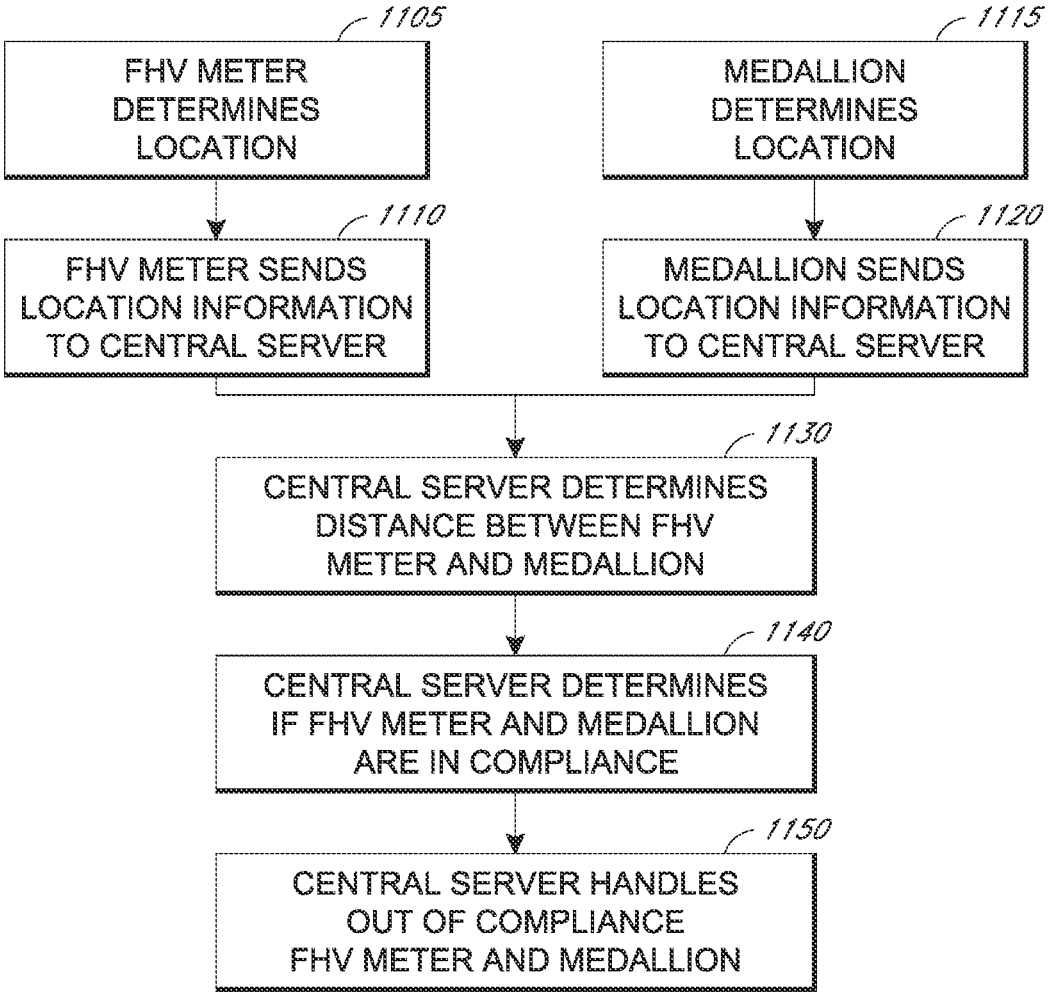
FIG. 11 shows one method of communication of the exemplary embodiment of FIG. 6.

In some embodiments, such as the exemplar embodiment of FIG. 6 and FIG. 11, message processing module 760 may receive messages from FHV Meter 100 and medallion 110 and determine whether FHV Meter 100 is operating in compliance with the appropriate medallion. The message from FHV Meter 100 may include, for example, a FHV Meter ID that uniquely identifies the meter, a location of the FHV Meter 100, a time indicating when the location value was recorded, or any other data collected or stored by FHV meter 100 that a person with ordinary skill in the art may think is of interest to message processing module 760. The message from the medallion may include, for example, a medallion ID that uniquely identifies the meter, a location of the medallion, a time indicating when the location value was recorded, etc. In some embodiments, message processing module 760 may verify compliance and initiate action if it determines that FHV Meter 100 is not operating with a medallion or is operating with an incorrect, or non-compliant, medallion. For example, message processing module 760 may create an alert indicating that FHV Meter 100 is not operating with a complaint medallion. The alert may be, in some embodiments, a user interface alerting a user of central server 140 that a FHV meter has become disconnected from its meter. In other embodiments, meter tracking module 770 may receive the alert so that it may track the disconnected FHV meter. In other embodiments, message processing module 760 may create a "kill message" that central server sends to FHV Meter 100 over network commanding FHV Meter 100 to cease operations. FHV Meter 100 advantageously ceases operations by completing the current fare it is calculating (if it is in the middle of a fare when the kill message is received) or FHV Meter 100 may immediately shut down, for example. In some embodiments, FHV Meter 100 may be connected to the computer system of FHV 120 and may shut down FHV 120 (e.g., command the engine of FHV 120 not to operate) when FHV Meter 100 receives a kill message. Advantageously, FHV meter 100 waits until it is safe to shut down FHV 120. For example, FHV meter 100 may only shut down FHV 120 when it is idling, as opposed to moving. In the event FHV Meter 100 wishes to shut down FHV 120 on receipt of a kill message and FHV 120 is motion, FHV Meter 100 may monitor the computer system of FHV 120 to detect when it has stopped so that FHV 120 is only shut down when it may be safe. Where a GPS location monitor is available to the meter the decision to instruct that the FHV motor be turned off may advantageously be made in a location that is safe such as in a parking lot and not while the FHV is idling in traffic. In such embodiments, once FHV 120 is shut down the regulatory agency may have a way of overriding the shutdown function so that the vehicle may be moved if safety or other public interest concerns warrant it. The override may be a message sent to FHV Meter 100 by central server 140, or in other embodiments, the override may be a key, or USB dongle, or other form of an authorization token that can be inserted directly into FHV Meter 100.

Figure 12:
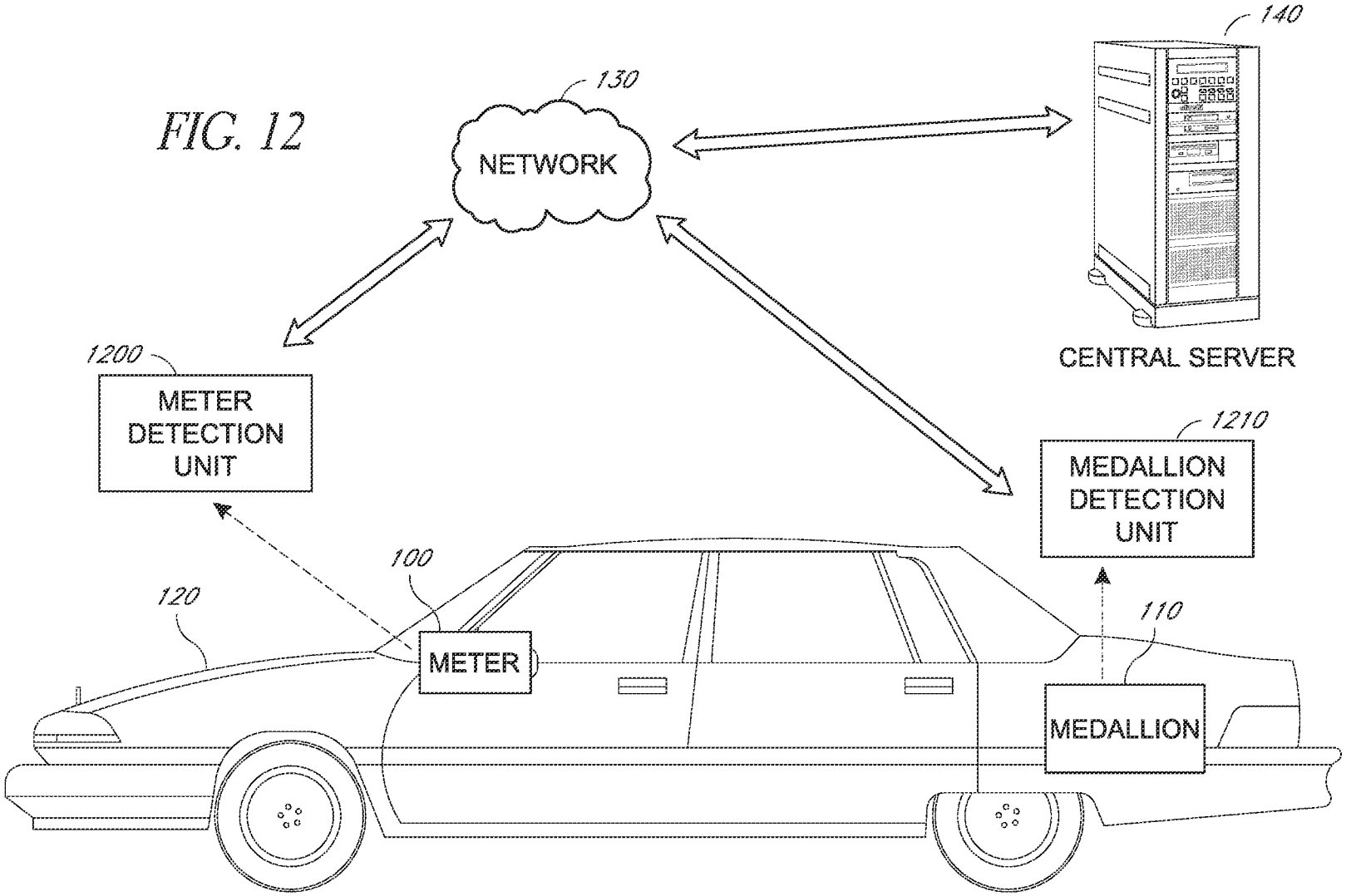
FIG. 12 is a block diagram of one embodiment of a FHV Meter in communication with meter detection unit, and a medallion in communication with medallion detection unit. The meter detection unit and the medallion detection unit are in communication with a central server.
Figure 13:
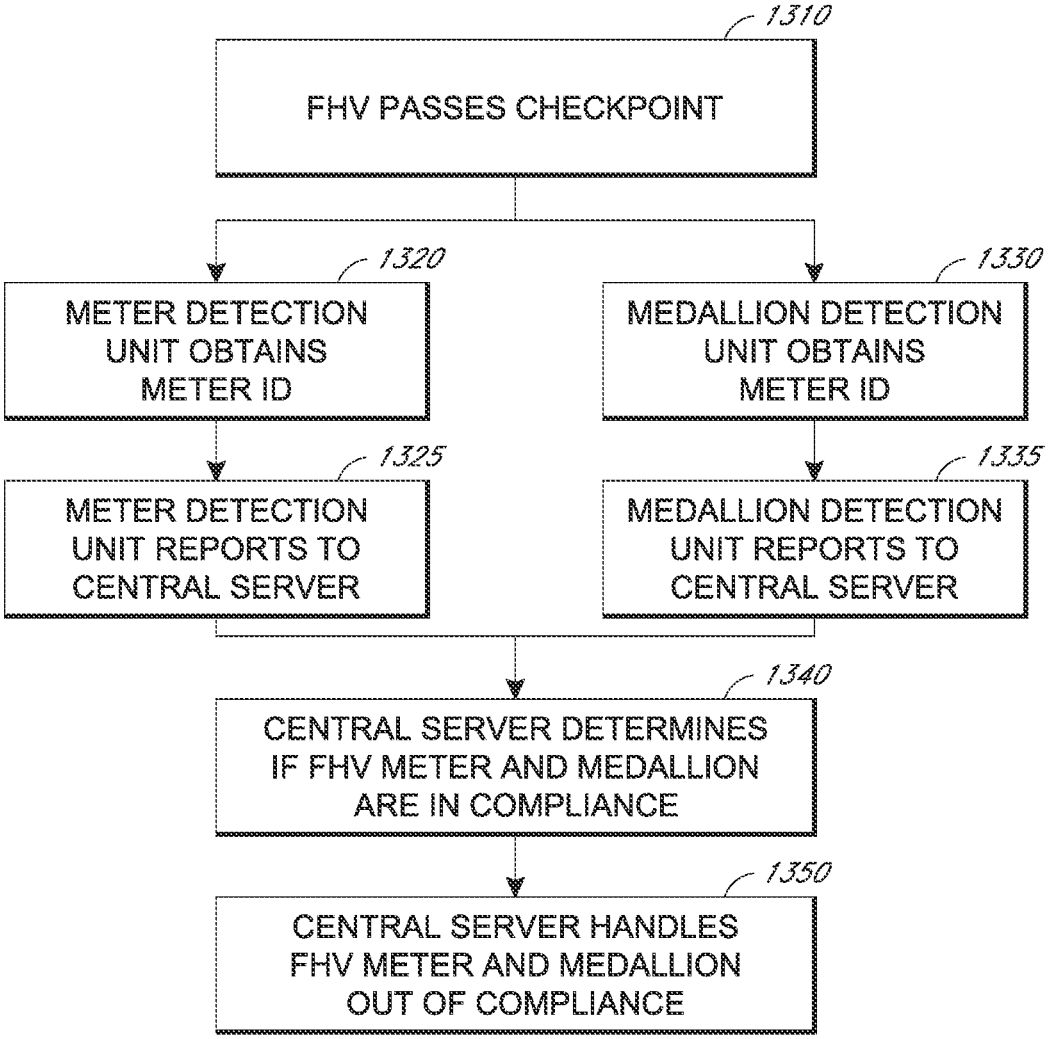
FIG. 13 shows a flowchart for the method of the exemplary embodiment of FIG. 12.

In other embodiments, such as the exemplar embodiment of FIGS. 12 and 13, message processing module 760 may receive messages sent from meter detection unit 1200 and/or medallion detection unit 1210 ("detection units"). The detection units may be installed at a fixed location, or checkpoint, and may detect FHV meter 100 or medallion 110 when FHV 120 drives past the checkpoint. Upon detection, the detection units may send a message to central server 140 that is then processed by message processing module 140. In some embodiments, the messages sent from the detection units may include, for example, the location of the detection unit, an identifier of the unit, a timestamp for the message, the location of the checkpoint, an identifier for a meter (including, for example, an associated RFID value stored in data store 740, or the meter identifier), an identifier for a medallion (including, for example, an associated RFID value stored in data store 740, or the medallion identifier), or any other data that may be needed to validate that the a FHV meter is connected to its associated medallion.

Central server 140 may include, in some embodiments, meter tracking module 770. In some embodiments, meter tracking module 770 may comprise software instructions that may be executed by CPU 710 to track and report the position of FHV Meters within the systems described herein. Meter tracking module 770 may work in conjunction with message processing module 760. For example, message processing module 760 may receive GPS coordinates for FHV meters entered into the system of central server 140 and stored in data store 740. Message processing module 760 may then send any meter location information to meter tracking module 770 for tracking purposes. In some embodiments, meter tracking module 770 may store received meter locations in data store 740 for reporting or maintaining historical records of the meters location.

Figure 10:
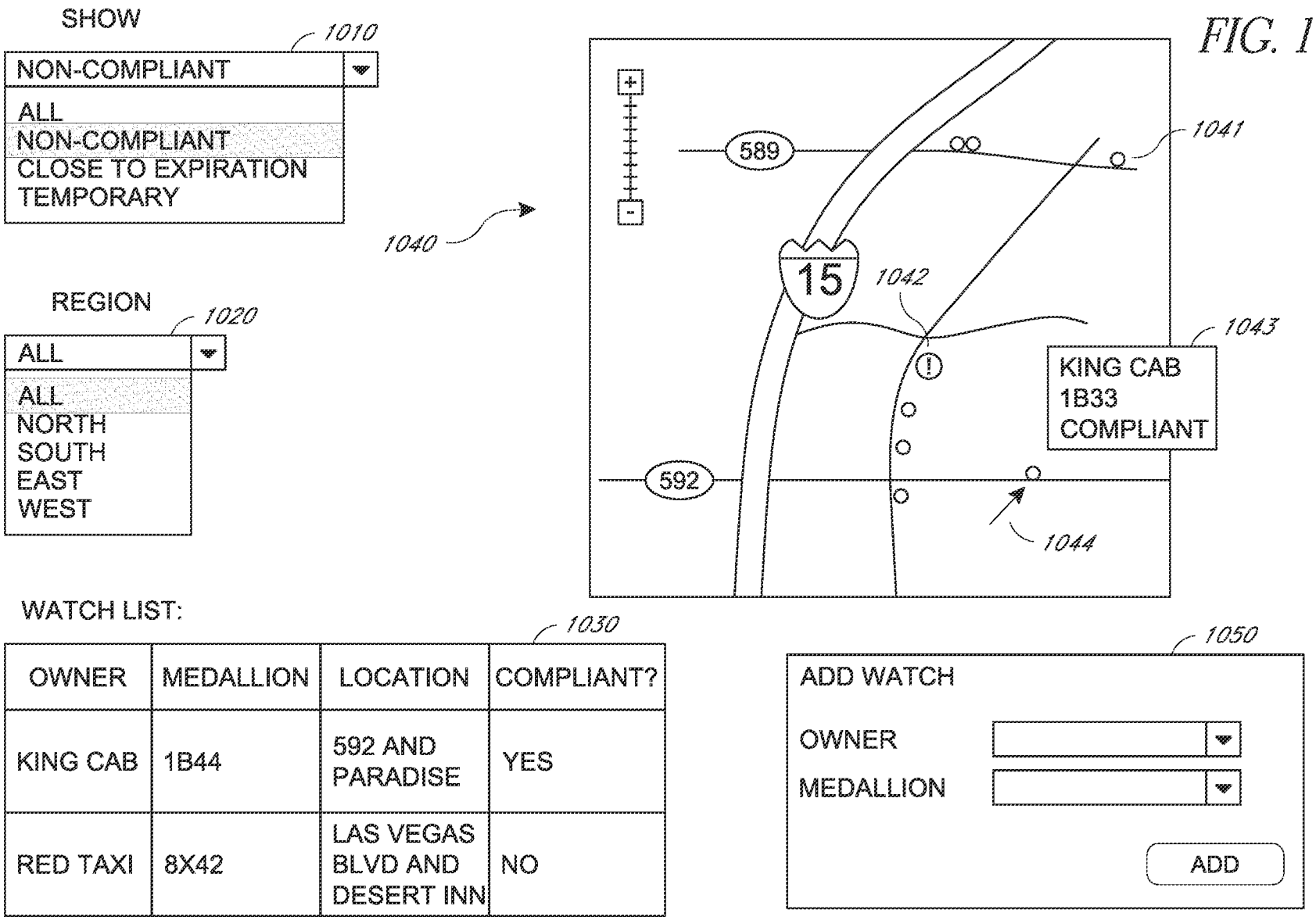

In some embodiments, meter tracking module 770 may generate a user interface similar to the exemplary user interface depicted in FIG. 10. Meter tracking module 770 may also, in other embodiments, provide a dedicated user interface that periodically reports on the location of meter that is no longer connected with its associated medallion. In some embodiments, a user may select a meter to watch or monitor. In such embodiments, meter tracking module 770 may update a user interface that indicates the location of the watched meter, such as for example watch list 1030.

Figure 8:
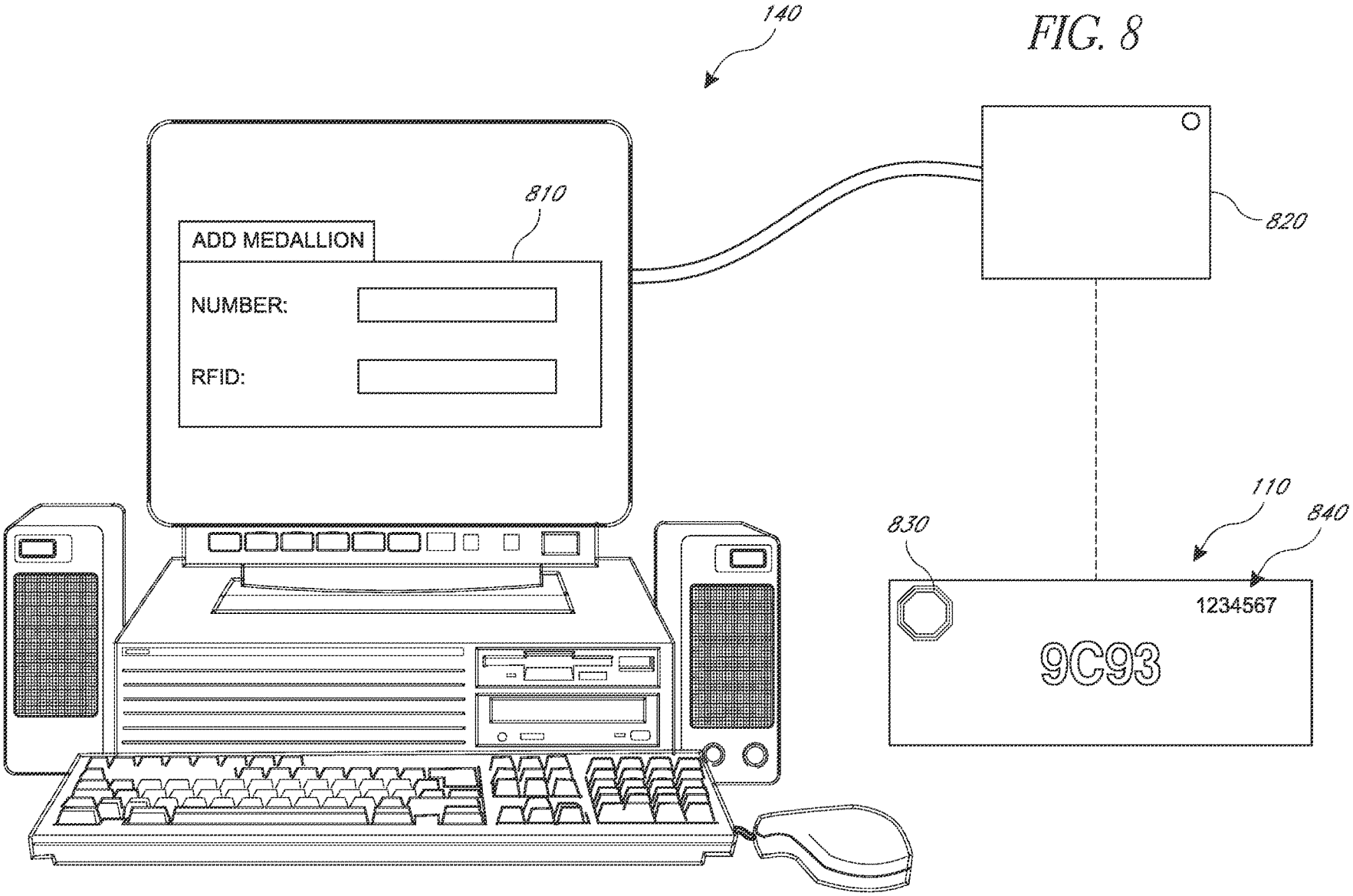
FIG. 8 shows one embodiment of a central server in the process of registering a medallion.

FIG. 8 depicts one embodiment of central server 140 in the process of registering medallion 110. Medallion 110 may comprise RFID tag 830. RFID reader 820 may be connected to central server 140 so that an agent of the regulatory agency may record within data store 740 of central server 140 the RFID value of RFID tag 830. In some embodiments, central server 140 may provide an add medallion user interface 810 so that an agent may add medallion information to data store 740 of central server 140. Medallion 110 may include a label 840 indicating the RFID value of RFID tag 830. An agent may use label 840 to enter the RFID value into user interface 810. In some embodiments, FHV meters outfitted with an RFID tag may be registered in a similar fashion to how medallions are registered with central server 140 in the embodiment depicted in FIG. 8. That is, a user interface 810 may allow for entry of a FHV meter serial number and an associated RFID tag 830. The tag may be swiped by RFID reader 820.

FIG. 9 and FIG. 10 show exemplary embodiments of user interfaces that may be available on central server 140. In some embodiments, the user interfaces may be displayed on a monitor directly connected to central server 140, that is, a monitor that is among I/O Devices and Interfaces 730. In other embodiments, the user interfaces maybe displayed on a remote computing system operating an application that employs the Remote Framebuffer (RFB) protocol for remote connections, such as, for example, VNC. In other embodiments, central server 140 may offer a web portal allowing for remote access to user interfaces similar to the ones depicted in FIG. 9 and FIG. 10. In such embodiments, the user interfaces of FIG. 9 and FIG. 10 may be implemented in a technology that allows for the generation of user interfaces in a web browser, such as HTML, ASP, JSP, Flash, Cold Fusion, PHP, or any other programming language or programming technology known by those skilled in the art.

FIG. 9 shows one embodiment of a user interface for viewing medallion-meter assignments and creating new assignments that may be displayed on output device of central server 140. In some embodiments, central server 140 may display a table view, such as current assignments user interface 910, that lists the medallion-meter assignments, or associations, stored in data store 740. User interface 910 may include indications of the owner of the medallion, the FHV meter serial number, the medallion number and the VIN number of the FHV that uses the meter and the medallion. In another embodiment, user interface 910 may allow for the assignment of one or more VINs to a medallion-meter pair. It can be appreciated by those in the state of the art that user interface 910 may also include other data not pictured in the exemplary embodiment of FIG. 9. For example, user interface 910 may also display other data stored in data store 740 that may be of interest to an operator of central server 140 based on the regulations put in place by the agency operating central server 140. In some embodiments, user interface 910 may be coded by leveraging existing APIs of the language in which user interface 910 may be coded to add additional functionality. For example, the API may allow for tables that can be sorted, resized, rearranged (row and column), employ drag-and-drop functionality, real time update functionality, printing functionality, or another any other standard functionality available to one skilled in the art.

In some embodiments, the current assignment user interface 910 may also employ functionality indicating to the user of central server 140 that a medallion-meter assigned pair is no longer connected. For example, when message processing module 760 determines that a medallion-meter pair is no longer connected, a notice may be generated to the user by changing the color of the row in user interface 910 corresponding to the disconnected medallion-meter pair. In another embodiment, the row may be highlighted, or may flash or blink, indicating that the meter and medallion are no longer connected.

In some embodiments, central server 140 may generate for display create new assignment user interface 950. User interface 950 may allow for meters stored in data store 740 to be assigned with medallions also stored in data store 740. User interface 950 may provide a series of cascading drop down boxes 951, 952, 953 and 954 that may provide information to a user so that the user can create a medallion-meter assignment or association. Owner drop down 951, for example, may contain a list of all owners stored in data store 740. A user may select a particular owner in order to more easily select a meter serial number. When a user selects a particular owner, drop down box 952 may populate with only those meter serial numbers corresponding to the owner. A user may, in some embodiments, also be able to select "All" so that all meter serial numbers are available for selection in drop down b. A user may then select a medallion from drop down 953 to associate with the selected meter serial number. Once the user has selected the appropriate medallion-meter pair for association, they may select the "Create" button. In some embodiments, central server 140 may display a confirmation dialog box requesting if the user wishes to proceed with the assignment.

In some embodiments, create new assignment user interface 950 may comprise text fields so that a user of central server 140 (or remote computer connected to central server 140) may type the characters corresponding to the meter and/or medallion the user wishes to assign. In other embodiments, user interface 950 may include lists user interface elements that allow the user to pick the meter and/or medallion the user wishes to assign. It can be appreciated by those skilled in the art that any combination of user interfaces may be available to create a new medallion-meter pair assignment.

In some embodiments, the medallion-meter association is one-to-one, that is, a medallion may be associated with only one meter at a time and a meter may only be associated with one medallion at a time. In such embodiments, if a user creates an assignment whereby either the meter or medallion is already associated, the previously associated meter or medallion will be unassociated. For example, suppose a user wishes to associate meter 1 and medallion A. The user will then select meter 1 from drop down 952 and Medallion A from drop down 954. The user then selects "Create." Medallion assignment module 750 will receive the new association but before it stores it in the data store, it may check to see if there are any previous associations. For example, meter 1 may have been assigned to medallion X and medallion A may have been assigned to meter 15. Medallion assignment module will then mark the previous associations for deletion in data store 740 and then write the new association, Meter 1-Medallion A to the data store. Medallion assignment module 750 will then execute a delete for any data rows marked for deletion. The end result is that medallion X (previously assigned to meter 1) and meter 15 (previously assigned to medallion A) no longer have an assignment.

FIG. 10 shows one embodiment of a user interface for tracking the location of FHV meters. A regulatory agency operating central server 140 may wish to see the location of meters operating within its jurisdiction of control. Central server 140 may display a user interface, such as the exemplary user interface of FIG. 10, to facilitate tracking of FHV meters. In some embodiments, meter tracking module 770 may generate a user interface such as map user interface 1040 for displaying the location of tracked FHV meters on a map. Map user interface may, in some embodiments, be implemented using a well known mapping tool or API, such as, for example, Google Maps, Falcon View, or any other readily available mapping tool that allows for overlay of graphics. Map user interface 1040 may display a series of icons, such as icon 1041 that represents the current location of a FHV meter. In some embodiments, FHV meters connected to a medallion may be displayed as an icon of one type and FHV meters disconnected from a medallion may be displayed as an icon of second type. For example, FHV meters connected to medallions may be represented by a closed green dot, such as icon 1041. Meters not connected to a medallion may be represented by a red exclamation point inside an open circle, such as icon 1042. In some embodiments, a user may use cursor 1044 to obtain additional details of the meter. When a user places cursor 1044 over icon 1041, or clicks on icon 1041 with cursor 1044, meter tracking module 770 may generate details pop-up display 1043. Details pop-up display may show details of the meter such as, for example, the owner of the medallion attached to the meter, the medallion ID, the compliance status of the meter, or any other data stored in data store 740 that one of skill in the art may think to include in details pop-up display 1043.

In some embodiments, the meters displayed on map user interface 1040 may be limited using drop down list filters, such as drop down 1010 and drop down 1020. Drop down 1010 may include filter options for limiting the display of icons in map user interface 1040. The options may include, for example, meters that are non-compliant (that is not connected to their assigned medallion or not operating in accordance with the authorization the medallion provides), meters with medallions that are close to expiration, meters that are connected to temporary or part time medallions, or any other filter criteria that one skilled in the art would think is important. Drop down 1020 may include additional filter criteria. For example, in exemplary FIG. 10, drop down 1020 allows the user to filer the icons displayed on map user interface 1040 based upon medallions limited by region. For example, if a user selects "North" from drop down 1020, only those meters assigned to medallions for operating for-hire vehicles in the north part of the jurisdiction might be displayed on map user interface 1040. In some embodiments, drop down 1010 and drop down 1020 may work as a combination filter, that is the condition specified in drop down 1010 and the condition specified in drop down 1020 may comprise an AND operation so that only those meters satisfying both conditions are displayed in map user interface 1040. In other embodiments, the conditions may comprise an OR operation, so that meters satisfying either condition are displayed in map user interface 1040. While exemplary FIG. 10 shows two filter drop downs, one skilled in the art can appreciate that one or more than two filter drop downs may be linked to map user interface 1040 to limit the number if icons displayed on the interface.

In some embodiments, meter tracking module 770 may generate a watch list user interface 1030 that allows a user to maintain a list of medallion-meter pairs that she wishes to monitor. Watch list user interface 1030 may include, for example, the owner of a medallion, the medallion serial identifier, the current location of the meter assigned to the medallion and whether the meter is compliant, or currently connected to its associated meter. It can be appreciated by those in the state of the art that watch list user interface 1030 may also include other data not pictured in the exemplary embodiment of FIG. 10. For example, user interface 1030 may also display other data stored in data store 740 that may be of interest to an operator of central server 140 based on the regulations put in place by the agency operating central server 140. In some embodiments, user interface 1030 may be coded by leveraging existing APIs of the language in which user interface 910 is implemented to add additional functionality. For example, the API may allow for tables that can be sorted, be resized, be rearranged (row and column), employ drag-and-drop functionality, employ real time update functionality, employ printing functionality, or employ another any other standard functionality available to one skilled in the art.

In some embodiments, the current location of watched FHV meters is displayed in watch list interface 1030. The location may be displayed as the major intersection that is closest to the watched FHV meter. For example, in the embodiment shown in FIG. 10, watched medallion "1B44" is closest to the intersection of 592 and Paradise. As "1B44" moves closer to another major intersection, watch list interface 1030 may update. In some embodiments, meter tracking module 770 comprises software code containing an algorithm for determining the closest intersection to the medallion. Meter tracking module 770 may, for example, access map data specifying the GPS coordinates of "major" intersections in the regulatory agency's jurisdiction. As meter tracking module 770 receives updated FHV meter locations, it may determine, based on the algorithm, the intersection coordinate for display. In other embodiments, watch list may display another name for a location, such as a map grid coordinate, a landmark, an address, or any other means of identifying a location known to those in the art. In such embodiments, meter tracking module 770 may contain an algorithm similar to the one discussed above with respect to intersections, except the comparison GPS points would correspond to the named locations used for display. In another embodiment, watch list user interface may display the current GPS coordinates of FHV meter. While detection of location has been explained above with reference to GPS coordinates, it can be appreciated that locations may be reported, analyzed and displayed in any coordinate system known in the art.

In some embodiments, meter tracking module 770 may generate an add watch user interface 1050 that allows a user to select a medallion they wish to monitor. In some embodiments, add watch user interface 1050 may include an owner drop down list containing the list of medallion owners within the jurisdiction. When a user selects one of the owners, the medallion drop down list populates with the medallions registered to that owner in the system. A user may add a watch by selecting the medallion of interest in the medallion drop down and then clicking "Add." Add watch user interface 1050 allows users to add medallions to watch before they have become disconnected from their associated meters. This may be advantageous, for example, in cases where the owner of the medallion has frequently disconnected medallions from FHV meters, or is a frequent subject of medallion theft or fraud.

In some embodiments, medallion-meter pairs may be added to watch list user interface 1030 if a meter becomes disconnected from its associated medallion. In some embodiments, the medallion-meter pair may be added automatically to the watch list. In other embodiments, a pop-up dialog may appear notifying the user that a FHV meter has alerted central server 140 that it has become disconnected from its associated medallion. The pop-up dialog may ask the user if they would like to add the medallion-meter pair to their watch list. If the user indicates that it would like to add the medallion-meter pair, it gets added to watch list user interface 1030. If the user indicated that it would not like to add the medallion-meter pair it is not added to watch list user interface 1030.

FIG. 11 shows one method of communication for the exemplary embodiment shown in FIG. 6. In box 1105 the FHV Meter 100 determines its location. In some embodiments, this may be done, for example, by meter geospatial recognition module 420. Once FHV Meter 100 determines its location, it communicates its location information and identification information to central server in box 1110. In one embodiment, the communication is done wirelessly over network 130. In box 1115, medallion 110 determines its location. In some embodiments, this may be done, for example, by geospatial recognition module 440. Once medallion 110 determines its location it communicates its location information and identification information to central server 140 in box 1120. The communication may be done, for example, over a wireless network.

In some embodiments, it may be desired to sync the location information of both FHV Meter 100 and medallion 110 because the latency between recording the locations for FHV Meter 100 and medallion 110 may introduce errors in the distance calculation performed by central server 140 at box 1130. FHV Meter 100 and medallion 110 may be programmed to report locations at the same time, for example, every five minutes. FHV Meter 100 and medallion 110 may determine when to report location and identification information based on the GPS values received by geospatial recognition modules 420 and 440. For example, FHV Meter 100 and medallion 110 may be programmed to report location and identification information every hour, on the hour, as received by geo spatial recognition modules 420 and 440. In some embodiments, the FHV Meters and medallions monitored by central server 140 may be staggered so that network resources are efficiently used.

Once central server 140 receives the identification and location information for FHV Meter 100 and medallion 110, it determines the distance between them. In some embodiments, central server 140 may receive data from several FHV Meters and medallions at once. Central server 140 must then determine which data sets are paired based on pairing values stored in its database. For example, when central server receives location information for FHV Meter with identification number 111 at 21:00, it may determine the expected paired medallion by searching in its database. If the paired medallion is medallion with serial identifier 999, central server 140 may then look for location information received by medallion with serial identifier 999 at 21:00 in order to determine the distance between the FHV Meter and medallion. Once central server 140 determines the locations of the paired FHV Meter and medallion at a particular time, it can then compare the locations to determine the distance between them.

In box 1140, central server determines if FHV Meter 100 and medallion 110 are operating in compliance, that is FHV Meter 100 is connected to its associated medallion and a determination is made regarding whether the meter is operating within the rules of the medallion. Compliance may be determined, in some embodiments, by comparing the distance between FHV Meter 100 and medallion 110 to a predetermined range or compliance threshold range. For example, regulations may dictate that a FHV Meter 100 must be within 10 ft of its medallion. Accordingly, the predetermined range will be set to 10 ft, and FHV Meters that are calculated by central server 140 to be further than 10 ft away from their paired medallion will be determined to be non-compliant with regulations. In addition, central server 140 may determine whether the FHV Meter 100 and medallion 110 are operating in compliance by validating that the current state of FHV Meter 100 and medallion 110 in order to abide by the authorization rules associated with medallion 110 as described above with respect to FIG. 5A.

In box 1150, central server 140 handles out of compliance FHV Meters. In some embodiments, central server 140 may handle out of compliance FHV Meters by ceasing operation of FHV Meter 100. In other embodiments, central server 140 may generate an alert message that a particular FHV Meter 100 is out of compliance along with the current location of the FHV Meter 100. Central server 140 may then generate user interfaces that may track the location of non-compliant FHV meters as described with respect to FIGS. 7-10 above.

FIG. 12 is a block diagram of one embodiment of FHV Meter 100 in communication with meter detection unit 1200, and medallion 110 in communication with medallion detection unit 1210. Meter detection unit 1200 and medallion detection unit 1210 ("detection units") may be in communication with central server 140 via network 130. The detection units may be installed in a fixed location, such as a traffic light or street overpass. In some embodiments, the detection units may be incorporated in one device. When FHV 120 drives near, or passes, the detection units, a message may be sent to central server 140 registering the location of both FHV Meter 100 and medallion 110.

In the embodiment of FIG. 12, FHV Meter 100 may have an operating token or tag that uniquely identifies FHV Meter 100 and is detectable by meter detection unit 1200. For example, FHV Meter 100 may have an RFID tag uniquely identifying FHV Meter 100. Further, in some embodiments, medallion 110 may have an operating token or tag that uniquely identifies medallion 110 and is detectable by medallion detection unit 1210. For example, medallion 110 may have an RFID tag uniquely identifying the medallion.

In some embodiments where FHV Meter 100 and medallion 110 communicate over a WiFi network, the detection units may be software modules that execute on an existing WiFi network in order to leverage an established infrastructure. The software modules may, for example, be executed on WiFi servers located at popular chains with many locations, such as a gas station chain, a coffee shop chain, or a fast food chain, for example.

FIG. 13 shows a flowchart for the method of the exemplary embodiment of FIG. 12. Starting in box 1310, a FHV may pass a checkpoint which triggers execution of the steps in boxes 1320 and 1330. In box 1320, meter detection unit 1200 obtains the identification of the FHV meter that passed the checkpoint, and in box 1330, medallion detection unit 1210 obtains the identification of the medallion that passed the checkpoint. In box 1325 and box 1335, the obtained identifications of the FHV meter and the medallion are then sent to central server 140. Central server 140 may then, at Box 1340, verify whether the detected FHV Meter is in compliance by comparing the received identification value pair with an expected identification value pair stored in a database connected to central server 140. In addition, central server 140 may determine whether the FHV Meter 100 and medallion 110 are operating in compliance by validating that the current state of FHV Meter 100 and medallion 110 in order to ensure that they abide by the authorization rules associated with medallion 110 as described above with respect to FIG. 5A. In box 1350, if the value pairs do not match, central server may determine that the FHV Meter is non-compliant. In some embodiments, if central server 140 determines that FHV Meter is non-compliant it may handle it by ceasing operation of the FHV Meter 100 or the vehicle to which FHV Meter 100 is attached (such as, FHV 120). In other embodiments, central server 140 may generate an alert message that the FHV Meter is out of compliance along with the current location of the FHV Meter, or central server may, in some embodiments, track the medallion-meter pair that is non-compliant as described above with respect to FIGS. 7-10.

All of the methods and tasks described herein may be performed and fully automated by a computer system. The computer system may in some cases include multiple distinct computers or computing devices (e.g., physical servers, workstations, storage arrays, etc.) that communicate and interoperate over a network to perform the described functions. Each such computing devices typically includes a processor (or multiple processors) that executes program instructions or modules stored in a memory or other non-transitory computer-readable storage medium. The various functions disclosed herein may be embodied in such program instructions, although some or all of the disclosed functions may alternatively be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices such as solid state memory chips and/or magnetic disks, into a different state.

The foregoing description details certain embodiments of the invention. It will be appreciated, however, that no matter how detailed the foregoing appears in text, the invention can be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A for-hire vehicle system comprising:

a for-hire vehicle meter;

a medallion;

said medallion comprising tangible non-transitory electronic data storage, said tangible non-transitory electronic data storage programmed with data that is unique to said medallion;

said medallion configured to be communicably coupled to said for-hire vehicle meter, when said for-hire vehicle meter is in operation;

said for-hire vehicle meter comprising a tangible, non-transitory memory storing instructions that cause said for-hire vehicle meter to:

receive a request to initiate a passenger fare; and determine whether said medallion is communicably coupled to said for-hire vehicle meter, wherein determining whether said medallion is communicable coupled to said for-hire vehicle comprises one or more of:

said for-hire vehicle meter attempting to retrieve the data that is unique to said medallion; or transmitting the data, that is unique to said medallion, to said for-hire vehicle meter; and determine whether to initiate the passenger fare based at least in part on the determination of whether the medallion is communicably coupled to the for-hire vehicle meter.

2. The system of claim 1 wherein the instructions further cause said for-hire vehicle meter to provide a discernable notice that the passenger fare cannot be initiated when said for-hire vehicle meter determines not to initiate the passenger fare.

3. The system of claim 1 wherein upon determining not to initiate a passenger fare, the instructions further cause said for-hire vehicle meter to:

generate a message indicating that said for-hire meter is not operating in accordance with the authorization data; and, send the message to a reporting computer system.

4. The system of claim 1 wherein said for-hire vehicle meter is attached to or is part of a for-hire vehicle; and said tangible, non-transitory memory is attached or is part of the for-hire vehicle.

5. The system of claim 1 wherein said for-hire vehicle meter is attached to or is part of a for-hire vehicle; and said tangible, non-transitory memory is not attached or is not part of the for-hire vehicle.

6. The system of claim 1 wherein the instructions create an indication that said medallion is connected to said for-hire vehicle meter when the results of the determination of whether said medallion is communicably coupled to said for-hire vehicle meter results in a determination that said medallion is communicably coupled to said for-hire vehicle meter.

7. The system of claim 6 further comprising hardware providing a wireless connection between said for-hire vehicle meter and said medallion.

8. The system of claim 6 wherein the indication is accessed from a wired connection.

9. The system of claim 1 wherein the data that is unique to said medallion comprises a medallion number.

10. The system of claim 1 wherein said tangible non-transitory electronic data storage is further programmed with geographic operational boundaries.

11. The system of claim 1 wherein said for-hire vehicle system further comprises a global positioning system receiver.

12. The system of claim 11 wherein said tangible non-transitory memory further comprises instructions that consider an output of the global positioning receiver when determining whether to initiate the passenger fare.

13. The system of claim 1 wherein the data that is unique to said medallion was issued by a regulatory authority of for-hire vehicles.

14. The system of claim 1 further comprising a network that is communicably coupled to said for-hire vehicle meter.

15. The system of claim 1 further comprising a network that is communicably coupled to said medallion and to a regulatory authority of for-hire vehicles.

16. The system of claim 1 further comprising a database that contains indicia of an association of a said medallion and said for-hire vehicle meter.

17. The system of claim 1 further comprising a wired connection between said medallion and said for-hire vehicle meter.

18. The system of claim 1 wherein said for-hire vehicle meter and said medallion each comprise a wireless data transmitter and wherein said medallion and said for-hire vehicle meter are wirelessly connected.

19. The system of claim 1 wherein said tangible non-transitory electronic data storage, said tangible non-transitory electronic data storage of said medallion further comprises authorization rules that define parameters by which a for-hire vehicle may accept fares.

20. The system of claim 19 wherein said authorization rules comprise parameters which establish an acceptable operating time period by which the for-hire vehicle may accept fares.

* * * * *